US010495273B2

(12) United States Patent
Di Trapani et al.

(10) Patent No.: US 10,495,273 B2
(45) Date of Patent: Dec. 3, 2019

(54) MODULAR SUN-SKY-IMITATING LIGHTING SYSTEM

(71) Applicant: COELUX S.R.L., Lomazzo (IT)

(72) Inventors: Paolo Di Trapani, Cavallasca (IT); Davide Magatti, Capiago Intimiano (IT); Antonio Lotti, Arcisate Varese (IT); Giorgio Gatti, Lurate Caccivio (IT)

(73) Assignee: CoeLux S.r.l., Lomazzo (IT)

( * ) Notice: Subject to any disclaimer, the term of this patent is extended or adjusted under 35 U.S.C. 154(b) by 0 days.

(21) Appl. No.: 15/776,999

(22) PCT Filed: Nov. 19, 2016

(86) PCT No.: PCT/EP2016/001943
§ 371 (c)(1),
(2) Date: May 17, 2018

(87) PCT Pub. No.: WO2017/084756
PCT Pub. Date: May 26, 2017

(65) Prior Publication Data

US 2018/0335188 A1 Nov. 22, 2018

(30) Foreign Application Priority Data

Nov. 19, 2015 (EP) ..... PCT/EP2015/077169

(51) Int. Cl.
*F21V 9/02* (2018.01)
*F21S 8/00* (2006.01)
(Continued)

(52) U.S. Cl.
CPC ..... *F21S 8/006* (2013.01); *F21S 8/026* (2013.01); *F21V 3/049* (2013.01); *F21V 5/043* (2013.01);
(Continued)

(58) Field of Classification Search
CPC ..... F21S 8/006; F21S 8/026; F21V 3/049; F21V 5/043; F21V 7/0008; F21V 7/005;
(Continued)

(56) References Cited

U.S. PATENT DOCUMENTS 6,737,151 B1 5/2004 Smith
8,068,285 B1 11/2011 Flynn
(Continued)

FOREIGN PATENT DOCUMENTS

CN 101983302 A 3/2011
DE 4033545 A1 4/1992
(Continued)

OTHER PUBLICATIONS

Examiner Arthur Thibaut, Search Report, The Hague, counterpart Italian Patent Application No. IT201800005680, dated Dec. 13, 2018, 10 pages total (including English translation of 5 pages).
(Continued)

*Primary Examiner* — Y M. Lee
(74) *Attorney, Agent, or Firm* — DiBerardino McGovern IP Group LLC

(57) ABSTRACT

A lighting system (100A, 100B) comprises a light source (102) for emitting a light beam stripe (220B) with a plurality of light emitting units (603, 803A, 803B) forming an array in the longitudinal direction (X), and an optical element (870) at the exit side of the light source (102) extending across the plurality of light emitting units, and configured to enlarge the beam divergence in the transversal direction. The lighting system (100A, 100B) further comprises a reflector unit, a support structure (210), and a reflective surface (104) with an essentially linear shape in the longitudinal direction (X) and a curved shape in the longitudinal transverse direction (Y), and a chromatic diffusing layer (108) comprising a plurality of nanoparticles embedded in a matrix, wherein the
(Continued)

chromatic diffusing layer (108) is positioned such that at least a portion of the reflected light beam (220A) passes through the chromatic diffusing layer (108), thereby generating diffuse light by scattering more efficiently the short-wavelengths components of the light in the visible spectral range than the long-wavelength components of the light in the visible spectral range.

24 Claims, 7 Drawing Sheets

(51) Int. Cl.

| | |
|---|---|
| ***F21S 8/02*** | (2006.01) |
| ***F21V 3/04*** | (2018.01) |
| ***F21V 7/00*** | (2006.01) |
| ***F21V 7/22*** | (2018.01) |
| ***F21V 5/04*** | (2006.01) |
| ***F21V 7/06*** | (2006.01) |
| *F21Y 103/10* | (2016.01) |
| *F21Y 115/10* | (2016.01) |

(52) U.S. Cl.
CPC ..... *F21V 7/005* (2013.01); *F21V 7/0008* (2013.01); *F21V 7/0083* (2013.01); *F21V 7/06* (2013.01); *F21V 7/22* (2013.01); *F21Y 2103/10* (2016.08); *F21Y 2115/10* (2016.08)

(58) Field of Classification Search
CPC . F21V 7/0083; F21V 7/06; F21V 7/22; F21V 3/0615; F21V 3/0625; F21V 9/02; F21V 9/04; F21V 9/06; F21V 9/35; F21V 9/40; F21V 7/0066; F21Y 2103/10; F21Y 2115/10
See application file for complete search history.

(56) References Cited

U.S. PATENT DOCUMENTS

| | | | |
|---|---|---|---|
| 2008/0285134 | A1 | 11/2008 | Closset et al. |
| 2008/0302461 | A1 | 12/2008 | Hayes et al. |
| 2011/0026257 | A1 | 2/2011 | Ando et al. |
| 2012/0080998 | A1 | 4/2012 | Yu et al. |
| 2013/0039050 | A1 | 2/2013 | Dau et al. |
| 2014/0070724 | A1 | 3/2014 | Gould et al. |
| 2016/0356452 | A1 | 12/2016 | Ebner |
| 2016/0363777 | A1 | 12/2016 | Flynn et al. |
| 2017/0074486 | A1 | 3/2017 | Flynn et al. |

FOREIGN PATENT DOCUMENTS

| | | | |
|---|---|---|---|
| DE | 102014202461 | A1 | 8/2015 |
| EP | 1179515 | A1 | 2/2012 |
| GB | 2450192 | C | 12/2008 |
| WO | 2005101445 | A1 | 10/2005 |
| WO | 2009156347 | A1 | 12/2009 |
| WO | 2009156348 | A1 | 12/2009 |
| WO | 2012014239 | A1 | 2/2012 |
| WO | 2014058748 | A1 | 4/2014 |
| WO | 2014076656 | A1 | 5/2014 |
| WO | 2015172821 | A1 | 11/2015 |
| WO | 2017081660 | A1 | 5/2017 |
| WO | 2018045469 | A1 | 3/2018 |
| WO | 2018091060 | A1 | 5/2018 |
| WO | 2018091150 | A1 | 5/2018 |

OTHER PUBLICATIONS

Remko Dinkla, European International Searching Authority, International Search Report and Written Opinion of International Searching Authority, counterpart PCT Application No. PCT/EP2016/001943, dated Feb. 15, 2017, 11 pages total.

Remko Dinkla, European International Preliminary Examining Authority, Written Opinion of International Preliminary Examining Authority, counterpart PCT Application No. PCT/EP2016/001943, dated Oct. 19, 2017, 7 pages total.

Sabine Bonfils, European International Preliminary Examining Authority, International Preliminary Report on Patentability, counterpart PCT Application No. PCT/EP2016/001943, dated Mar. 7, 2018, 19 pages total.

Friedhelm Fensterseifer, "Reflection Haze," BYK-Gardner Catalog, 2010/2011, pp. 27-28 (2 total pages).

T.C. Greenfell et al., "Representation of a non-spherical ice particle by a collection of independent spheres for scattering and absorption of radiation," Journal of Geophysical Research, vol. 104, No. D24, pp. 31,697-31,709 (13 total pages), Dec. 27, 1999.

National Intellectual Property Administration of PRC, Third Office Action, counterpart Chinese Application No. 2016800792506, dated Aug. 13, 2019, 12 pages total (including partial English translation of 4 pages).

200
210
204
204A
216
220B
102
212
214
220A 200
210
204
102
216

214
222
216
224

MODULAR SUN-SKY-IMITATING LIGHTING SYSTEM

TECHNICAL FIELD

The present disclosure relates generally to lighting systems, in particular to lighting systems for optically providing a widened perception/impression of the ambient space and in particular for imitating natural sunlight illumination. Moreover, the present disclosure relates generally to implementing such a lighting system in an indoor room ambient space, as well as to light sources for such lighting systems.

BACKGROUND

Mirrors became essential components of indoor architecture as they are capable of improving the comfort of an ambience through a widening in the perceived volume. In general, in modern and contemporary architecture, reflective surfaces are used to provide for specific perceptions by an observer.

The following disclosure is at least partly based on specific nanoparticle based reflective units, and their application in the field of active illumination such as in lighting in general.

As will be disclosed herein, the specific nanoparticle based reflective units may be used to provide for a specific visual perception of a wall for the observer. Those units may provide specific chromatic and reflective features that provide for properties of sun imitating lighting systems such as described, for example, in the international patent application PCT/EP2014/059802, filed on 13 May 2014 by the same applicants, in which reflective and diffusing layers are combined.

On Rayleigh-like diffusing layers, several applications such as EP 2 30 478 A1, EP 2 304 480 A1, and WO 2014/076656 A1, filed by the same applicants, disclose lighting systems that use a light source producing visible light, and a panel containing nanoparticles used in transmission, i.e. the light source and the illuminated area are positioned on opposing sides of the panel. During operation of those lighting systems, the panel receives the light from the light source and acts in transmission as a so-called Rayleigh diffuser, namely it diffuses incident light similarly to the earth atmosphere in clear-sky conditions. Specifically, the concepts refer to directional light with lower correlated color temperature (CCT), which corresponds to sunlight, and diffuse light with larger CCT, which corresponds to the light of the blue sky.

Introducing a reflective feature as, for example, in PCT/EP2014/059802 mentioned above, however, may affect the perception due to the presence of the reflection due to inhomogeneity in color and luminance that may affect the desired optical and visual effect.

The present disclosure is directed, at least in part, to improving or overcoming one or more aspects of prior systems.

SUMMARY OF THE DISCLOSURE

Some or all of those aspects are addressed by the subject-matters of the independent claims. Further developments of the invention are given in the dependent claims.

With respect to the chromatic diffusing layer applied to the reflective structural unit or presented separately to a reflector to be subject to a double pass or single pass of the light from the light source, the present disclosure relates to an optical diffuser as disclosed in WO 2009/156348 A1, filed by the same applicants, as a sky-sun nanodiffuser in the noon configuration. Therein the term "sky-sun nanodiffuser" designates an optical diffuser that simulates the diffusion of the sunlight by the sky in nature. Accordingly, the herein disclosed chromatic reflective unit may relate in some embodiments to an optical nanodiffuser of that type disclosed in WO 2009/156348 A1. In particular, the chromatic diffusing layer may comprise an essentially transparent solid matrix in which a plurality of solid essentially transparent nanoparticles are dispersed, e.g. in a thin film, coating, or bulk material such as sandwich embodiments. In the present description the terms "diffusing layer", "nanodiffuser", and in actively illuminated embodiments "chromatic diffusing layer" designate in general an optical element, which comprises a matrix embedding those (essentially transparent) nanoparticles.

The chromatic diffusing layer is in principle capable of (chromatically) separating different chromatic components of incident light having a broad spectral bandwidth (such as in general white light) according to the same mechanism that gives rise to chromatic separation in nature. Rayleigh scattering is creating, for example, the spectral distribution characteristic of skylight and sunlight. More particularly, the chromatic diffusing layer is capable of reproducing—when subject to visible white light—the simultaneous presence of two different chromatic components: a diffused sky-like light, in which blue—in other words the blue or "cold" spectral portion—is dominant, and a transmitted and by the reflective surface reflected incident light, with a reduced blue component—in other words the yellow or "warm" spectral portion.

Referring to reflecting properties of a chromatic reflective section of the chromatic reflective unit, its structure is such that it achieves—based on the nanoparticles—such a specific optical property that comprises a specular reflectance that is larger in the red than in the blue, and a diffuse reflectance that is larger in the blue than in the red. The optical property can be fulfilled, for example, over at least 50% of the reflective surface section, preferably over at least 70%, or even over at least 90%.

Herein, as defined in the Standard Terminology of Appearance, ASTM international, E 284-09a, the reflectance is in general the ratio of the luminous flux to the incident flux in the given conditions. For example, the diffuse reflectance is a property of the respective specimen that is given by the ratio of the reflected flux to the incident flux, where the reflection is at all angles within the hemisphere bounded by the plane of measurement except in the direction of the specular reflection angle. Similarly, the specular reflectance is the reflectance under the specular angle, i.e. the angle of reflection equal and opposite to the angle of incidence. In the context of the present disclosure, for a given wavelength and a given position on the reflective surface section, the diffuse reflectance and the specular reflectance are intended for non-polarized incident light with an incident angle of 45° with respect to the normal to the reflective surface section at the given position. For measurements, the angular size of the detector for the measurement of specular reflection and the angular aperture of the incident beam is selectable in a range as it will be apparent to the skilled person. In particular when considering (white light) low angle diffusers, for example, the angular size of the detector for the measurement of specular reflection and the angular aperture of the incident beam should be configured so that the sensor accepts rays with a reflection within a cone around the reflection axis. In some embodiments, an angular aperture of 2 times 0.9° may be used as disclosed, for example, in BYK-Gartner "Perception and Objective Measurement of Reflection Haze" for hazemeters and glossmeters introduction, Friedhelm Fensterseifer, BYK-Gardner, BYK-Gardner Catalog 2010/2011).

Moreover, the reflected flux is averaged over all possible incidence azimuthal angles. In case the measurement of the diffused reflectance and/or the specular reflectance is hindered by geometrical or other physical constraints related to the configuration of the chromatic reflective unit, the skilled person may have access to the above mentioned quantities by forming at least one separate chromatic reflective section from the chromatic reflective unit and measuring the reflectance directly onto that section. For details of microscopic structural properties, it is referred to, for example, the above mentioned publication WO 2009/156348 A1. However different values of microscopic parameters may be applicable. For example, one may apply parameters that lead to a larger amount of scattered light with respect to non-scattered light. Similarly, in the aim of minimizing or at least reducing the visibility of the specularly reflected scene, one may prefer increasing the contribution to the luminance of the chromatic reflective unit due to diffused light in spite of the fact that the resulting perceived color may depart from the color of a perfect clear sky. The latter may be caused, for example, by reducing the level of color saturation as a consequence of the multiple scattering arising therein and may be even caused at concentrations below the concentration giving rise to multiple scattering.

In the following, some microscopic features are summarized exemplarily.

The chromatic effect is based on nanoparticles having a size in the range from, for example, 10 nm to 240 nm. For example, an average size may be in that range.

It is well known from fundaments of light-scattering that a transparent optical element comprising transparent matrix and transparent nanoparticles having different refraction index with respect to the matrix, and having sizes (significantly) smaller than visible wavelength, will preferentially scatter the blue part (the blue) of the spectrum, and transmit the red part (the red). While the wavelength-dependence of the scattering efficiency per single particle approaches the $\lambda^{-4}$ Rayleigh-limit law for particle sizes smaller or about equal to 1/10 of the wavelength $\lambda$, a respective acceptable optical effect may be reached already in the above range for the size of the nanoparticles. In general, resonances and diffraction effects may start to occur at sizes larger, for example, than half the wavelength.

On the other side, the scattering efficiency per single particle decreases with decreasing particle size d, proportional to $d^{-6}$, making the usage of too small particle inconvenient and requiring a high number of particles in the propagation direction, which in turn may be limited by an allowed filling-fraction. For example, for thick scattering layers, the size of the nanoparticles embedded in the matrix (and in particular their average size) may be in the range from 10 nm to 240 nm, such as 20 nm to 100 nm, e.g. 20 nm to 50 nm, and, for compact devices, e.g. using thin layers such as coatings and paints, the size may be in the range from 10 nm to 240 nm, such as 50 nm to 180 nm, e.g. 70 nm to 120 nm.

In some embodiments, larger particles may be provided within the matrix with dimensions outside that range but those particles may not affect the Rayleigh-like feature and, for example, only contribute to forming a low-angle scattering cone around the specular reflection.

The chromatic effect is further based on nanoparticles having a refractive index that is different from the refractive index of the embedding matrix. To scatter, the nanoparticles have a real refractive index $n_p$ sufficiently different from that of the matrix $n_h$, (also referred to as host material) in order to allow light scattering to take place. For example, the ratio m between the particle and host medium refractive indexes (with $$m \equiv \frac{n_p}{n_h})$$

may be in the range $0.55 \le m \le 2.5$ such as in the range $0.7 \le m \le 2.1$ or $0.7 \le m \le 1.9$.

The chromatic effect is further based on the number of nanoparticles per unit area seen by the impinging light propagating in the given direction as well as the volume-filling-fraction f. The volume filling fraction f is given by $$f = \frac{4}{3}\pi\left(\frac{d}{2}\right)^3 \rho$$

with $\rho$ [meter$^{-3}$] being the number of particles per unit volume. By increasing f, the distribution of nanoparticles in the diffusing layer may lose its randomness, and the particle positions may become correlated. As a consequence, the light scattered by the particle distribution experiences a modulation which depends not only on the single-particle characteristics but also on the so called structure factor. In general, the effect of high filling fractions is that of severely depleting the scattering efficiency. Moreover, especially for smaller particle sizes, high filling fractions impact also the dependence of scattering efficiency on wavelength, and on angle as well. One may avoid those "close packing" effects, by working with filling fractions $f \le 0.4$, such as $f \le 0.1$, or even $f \le 0.01$ such as $f = 0.001$.

The chromatic effect is further based on a number N of nanoparticles per unit area of the chromatic diffusive layer in dependence of an effective particle diameter $D = d\ n_h$. Thereby, d [meter] is the average particle size defined as the average particle diameter in the case of spherical particles, and as the average diameter of volume-to-area equivalent spherical particles in the case of non-spherical particles, as defined in [T. C. GRENFELL, AND S. G. WARREN, "Representation of a non-spherical ice particle by a collection of independent spheres for scattering and absorption of radiation". Journal of Geophysical Research 104, D24, 31,697-31,709. (1999)]. The effective particle diameter is given in meters or, where specified in nm.

In some embodiments:

$$N \ge N_{min} = \frac{1.03 \times 10^{-29}}{D^6}\left|\frac{m^2+2}{m^2-1}\right|^2 \text{[meters}^{-2}\text{]},$$

(D given in [meters]) and $$N \le N_{max} = \frac{0.61 \times 10^{-27}}{D^6}\left|\frac{m^2+2}{m^2-1}\right|^2 \text{[meters}^{-2}\text{]};$$

for example, $$N \geq N_{min} = \frac{2.12\times10^{-29}}{D^6}\left|\frac{m^2+2}{m^2-1}\right|^2 [\text{meters}^{-2}] \text{ and}$$

$$N \leq N_{max} = \frac{4.64\times10^{-28}}{D^6}\left|\frac{m^2+2}{m^2-1}\right|^2 [\text{meters}^{-2}],$$

more specifically $$N \geq N_{min} = \frac{4.5\times10^{-29}}{D^6}\left|\frac{m^2+2}{m^2-1}\right|^2 [\text{meters}^{-2}] \text{ and}$$

$$N \leq N_{max} = \frac{3.24\times10^{-28}}{D^6}\left|\frac{m^2+2}{m^2-1}\right|^2 [\text{meters}^{-2}].$$

For example, for embodiments aiming at simulating the presence of a pure clear sky, $$N \geq N_{min} = \frac{1.03\times10^{-29}}{D^6}\left|\frac{m^2+2}{m^2-1}\right|^2 [\text{meters}^{-2}],$$

(D given in [meters]) and $$N \leq N_{max} = \frac{1.85\times10^{-28}}{D^6}\left|\frac{m^2+2}{m^2-1}\right|^2 [\text{meters}^{-2}]$$

such as $$N \geq N_{min} = \frac{2.12\times10^{-29}}{D^6}\left|\frac{m^2+2}{m^2-1}\right|^2 [\text{meters}^{-2}] \text{ and}$$

$$N \leq N_{max} = \frac{1.40\times10^{-28}}{D^6}\left|\frac{m^2+2}{m^2-1}\right|^2 [\text{meters}^{-2}],$$

more specifically $$N \geq N_{min} = \frac{4.5\times10^{-29}}{D^6}\left|\frac{m^2+2}{m^2-1}\right|^2 [\text{meters}^{-2}] \text{ and}$$

$$N \leq N_{max} = \frac{1.03\times10^{-28}}{D^6}\left|\frac{m^2+2}{m^2-1}\right|^2 [\text{meters}^{-2}].$$

In other embodiments aiming at minimizing the contribution of a specular reflected scene, $$N \geq N_{min} = \frac{1.40\times10^{-28}}{D^6}\left|\frac{m^2+2}{m^2-1}\right|^2 [\text{meters}^{-2}],$$

(D given in [meters]) and $$N \leq N_{max} = \frac{0.61\times10^{-27}}{D^6}\left|\frac{m^2+2}{m^2-1}\right|^2 [\text{meters}^{-2}]$$

such as $$N \geq N_{min} = \frac{1.85\times10^{-28}}{D^6}\left|\frac{m^2+2}{m^2-1}\right|^2 [\text{meters}^{-2}] \text{ and}$$

$$N \leq N_{max} = \frac{4.64\times10^{-28}}{D^6}\left|\frac{m^2+2}{m^2-1}\right|^2 [\text{meters}^{-2}],$$

more specifically $$N \geq N_{min} = \frac{2.42\times10^{-28}}{D^6}\left|\frac{m^2+2}{m^2-1}\right|^2 [\text{meters}^{-2}] \text{ and}$$

$$N \leq N_{max} = \frac{3.24\times10^{-28}}{D^6}\left|\frac{m^2+2}{m^2-1}\right|^2 [\text{meters}^{-2}].$$

With respect to those physical parameters and their general interplay, it is again referred to, for example, WO 2009/156348 A1.

The macroscopic optical properties of the chromatic reflective unit disclosed herein, and in particular a chromatic reflective section, can be described in terms of the two following quantities:

(i) The monochromatic normalized specular reflectance R(λ), defined as the ratio between the specular reflectance of the chromatic reflective unit and the specular reflectance of a reference sample identical to the chromatic reflective unit except for the fact that the diffusing layer does not contain the nanoparticles having a size in the range from 10 nm to 240 nm, i.e. the nanoparticles which are responsible of preferentially diffusing the short wavelengths of the impinging radiation.

(ii) The ratio γ between the blue and the red optical densities defined as: γ≡Log [R(450 nm)]/Log [R(630 nm)] that measures the capacity of the chromatic reflective device to provide chromatic separation between long and short wavelength components of the impinging radiation.

In some embodiments, the chromatic reflective unit, and in particular a chromatic reflective section, may have:

R(450 nm) in the range from 0.05 to 0.95, for example from 0.1 to 0.9 such as from 0.2 to 0.8. For example for embodiments aiming at simulating the presence of a pure clear sky, R(450 nm) may be in the range from 0.4 to 0.95, for example from 0.5 to 0.9 such as from 0.6 to 0.8.

In embodiments aiming at reducing (e.g. minimizing) the contribution of a specular reflected scene, R(450 nm) may be in the range from 0.05 to 0.5, for example from 0.1 to 0.4 such as 0.2 up to 0.3.

With respect to the ratio γ between the blue and the red optical densities in some embodiments, γ may be in the range 5≥γ≥1.5, or even 5≥γ≥2, or even 5≥γ≥2.5 such as 5≥γ≥3.5.

For completeness, inorganic particles suited for this type of application may be those that include but are not limited to ZnO, $TiO_2$, $ZrO_2$, $SiO_2$, and $Al_2O_3$ which have, for example, an index of refraction $n_p$=2.0, 2.6, 2.1, 1.5, and 1.7, respectively, and any other oxides which are essentially transparent in the visible region. In the case of inorganic particles, an organic matrix or an inorganic matrix may be used to embed the particles such as soda-lime-silica glass, borosilicate glass, fused silica, polymethylmethacrylate (PMMA), and polycarbonate (PC). In general, also organic particles may be used, in particular for illuminated configurations having, for example, a reduced or no UV portion.

The shape of the nanoparticle can essentially be any, while spherical particles are most common.

As mentioned above, the nanoparticles and/or the matrix and/or further embedded particles may not—or may only to some limited extent—absorb visible light. Thereby, the luminance and/or the spectrum (i.e. the color) of the light exiting the chromatic reflective unit may only be very little or not at all affected by absorption. An essentially wavelength-independent absorption in the visible spectrum may be acceptable.

In some embodiments, a secondary chromatic diffusing layer associated light source is used, for example, for an additional illumination of the chromatic diffusing layer from the side. Exemplary embodiments are disclosed, for example, in WO 2009/156347 A1. In those embodiments, the chromatic diffusing layer may be configured to interact primarily with the light of that secondary light source or with the light from both light sources to provide for the diffuse light.

In some embodiments, a CCT of the diffuse light component from the luminous layer (e.g. in those propagation directions not associated with the illuminating light beam) is at least 1.2 times larger or at least 1.1 times larger than the CCT of the light of the illuminating light beam.

In some embodiments, the reflective surface is planar or curved such as a parabola.

Combining the above features of the chromatic diffusing layer with the structural features disclosed herein may allow addressing one or more aspects of the prior art as will be exemplarily described below for various exemplary embodiments.

Moreover, the luminous layer may be uniform, in the sense that, given any point of the luminous layer, the physical characteristics of the luminous layer in that point does not depend on the position of that point. Furthermore, the luminous layer may be monolithic.

In some embodiments, the spherically or otherwise shaped nanoparticles may be monodisperse and/or have an effective diameter D within the range [5 nm-350 nm], such as [(10 nm-300 nm], or even [40 nm-250 nm], or [60 nm-200 nm], where the effective diameter D is given by the diameter of the nanoparticles times the first material's refractive index.

Moreover, nanoparticles may be distributed inside the luminous layer in a manner such that their areal density, namely the number N of nanoparticles per square meter, i.e. the number of nanoparticles within a volume element delimited by a portion of the surface of the luminous layer having an area of 1 $m^2$, satisfies the condition N≥Nmin, where:

$$N_{min} = \upsilon \frac{10^{-29}}{D^6} \cdot \left| \frac{m^2 + 2}{m^2 - 1} \right|^2$$

wherein ν is a dimensional constant equal to 1 $m^6$, Nmin is expressed as a number/$m^2$, the effective diameter D is expressed in meters and wherein m is the ratio between the particle and host medium refractive indices.

In some embodiments, the nanoparticles are distributed homogenously, at least as far as the areal density is concerned, i.e. the areal density is substantially uniform on the luminous layer, but the nanoparticle distribution may vary across the luminous layer. The areal density varies, for example, by less than 5% of the mean areal density. The aerial density is here intended as a quantity defined over areas larger 0.25 $mm^2$.

In some embodiments, the areal density varies, so as to compensate illumination differences over the luminous layer, as lit by the light source. For example, the areal density N(x,y) at point (x,y) may be related to the illuminance I(x,y) produced by the light source at point (x,y) via the equation N(x,y)=Nav*Iav/I(x,y)±5%, where Nav and Iav are the averaged illuminance and areal density, these latter quantities being averaged over the surface of the luminous layer. In this case the luminance of the luminous layer may be equalized, in spite of the non-uniformity of the illuminance profile of light source 2 on the luminous layer. In this context, the luminance is the luminous flux of a beam emanating from a surface (or falling on a surface) in a given direction, per unit of projected area of the surface as viewed from the given direction, and per unit of solid angle, as reported, as an example, in the standard ASTM (American Society for Testing and Materials) E284-09a.

In the limit of small D and small volume fractions (i.e. thick panels) an areal density N≈Nmin is expected to produce scattering efficiency of about 5%. As the number of nanoparticles per unit area gets higher, the scattering efficiency is expected to grow proportionally to N, until multiple scattering or interferences (in case of high volume fraction) occur, which might compromise color quality. The choice of the number of nanoparticles is thus biased by the search for a compromise between scattering efficiency and desired color, as described in detail in EP 2 304 478 A1. Furthermore, as the size of nanoparticles gets larger, the ratio of the forward to backward luminous flux grows, such ratio being equal to one in the Rayleigh limit. Moreover, as the ratio grows, the aperture of the forward scattering cone gets smaller. Therefore, the choice of the ratio is biased by the search for a compromise between having light scattered at large angles and minimizing the flux of backward scattered light.

Other features and aspects of this disclosure will be apparent from the following description and the accompanying drawings.

BRIEF DESCRIPTION OF THE DRAWINGS

The accompanying drawings, which are incorporated herein and constitute a part of the specification, illustrate exemplary embodiments of the disclosure and, together with the description, serve to explain the principles of the disclosure. In the drawings.

DETAILED DESCRIPTION

Figure 1A:
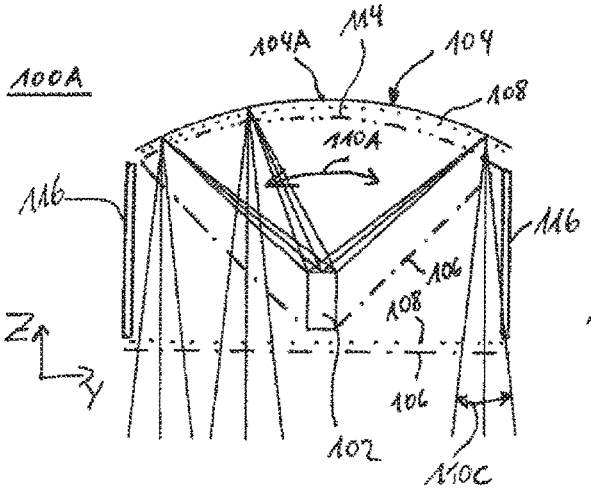
FIGS. 1A and 1B are schematic illustrations of an exemplarily lighting system for sun-sky-imitation with a trough-like reflector element.

The following is a detailed description of exemplary embodiments of the present disclosure. The exemplary embodiments described therein and illustrated in the drawings are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of patent protection. Rather, the scope of patent protection shall be defined by the appended claims.

The disclosure is based in part on the realization that to perceive sun-sky-imitation and the respective depth of the sky, the homogenization of the sky in perception as well as the remoteness of the sky with respect to the surrounding need special attention. Herein, various features are presented that alone or in combination with one or more others of those features may help ensuring the unique perception of the sun-sky-imitation.

The disclosure is further based in part on the realization that lighting systems for in particular indoor implementations benefit from an efficient use of the primarily generated light as well as an accessibility of in particular the light source for service and replacement.

The disclosure is further based in part on the realization that providing a modular configuration may allow flexibility in providing, for example, a desired length of the lighting system. In particular, the lighting system concepts disclosed herein provide configurations of lighting systems that are modular and allow, for example, the mounting several modules to form a linear array. In particular, it was realized that a modular configuration using identical modules may be achieved by separating the optical design for two orthogonal directions in different approaches. Specifically, it was realized that a trough-like reflector may provide a reflective structure that can be extended in particular in the longitudinal (cylinder-like axis) direction while maintaining an unchanged optical situation in that direction and essentially a smooth surface transition from module to module. In the transversal (cylinder-like radial) direction, the curvature of the reflector can be used as an optically collimating element. Although modules may also be aligned in that direction, the smooth surface transition as well as a change in the optical situation will be present. Accordingly, optical measures are proposed that can be used to support the homogeneous impression of the arrayed modules.

Furthermore, it was realized that there is a need for compact configurations that allow installations in surroundings with less available space. The herein disclosed lighting system concepts are designed in particular for use in corridors, walking tunnels, as well as in general long and narrow spaces such as they may be present in an underground indoor ambience. This is in particular supported by the underlying linear design. The illumination effect produced by the lighting system concepts is intended to give the impression of an opening in the ceiling and, thus, may help reducing the feeling of constraint.

With respect to the sun-sky-aspects, the lighting system concepts disclosed herein allow outputting two main light components: a lower correlated color temperature (CCT) light beam with narrow divergence and a diffuse, higher CCT component with large divergence angle. When looking at the lighting system output surface, it is one aim of the lighting system concept that an observer will interpret the higher CCT component as (blue) sky light and the lower CCT component as (bright) sun light. In consequence, the appearance of the lighting system may be designed such that an observer will see through an output surface behind which, for example, the image of a sun disk (or in some embodiments a broken-up structure of the sun disk) is surrounded by a uniform bluish background imitating the sky.

The lighting system concepts disclosed herein are based on in particular the following two aspects: A spectral aspect in which a Rayleigh-like scattering in the visible wavelength range is used and implemented by a transparent layer or a panel in which transparent nanoparticles are dispersed that have a specific refractive index that is difference from the underlying matrix. A sun beam aspect which is implemented by a two-stage collimation of a, for example, LED-based primary light source. The two-stage collimation is in particular using the above mentioned trough-like configuration of the reflecting unit.

Referring to reflective configurations, typically the high luminance of the light source, e.g. the high luminance of an exit pupil of the light source, tends to dominate—in terms of visual perception of the observer in the room—over the lower luminance of the rest of the scene reflected by the mirror. The effect of perception of infinite space/infinite distances beyond the reflector unit may remain in effect, if the objects in the ambience are excluded from perception within a reflective unit. Specifically, it was realized that such an exclusion may be ensured if one overlays a diffusive (mainly forward scattering) layer in the light propagation path (herein referred to as a frost layer), e.g. onto a reflective surface or at an output surface. In this context, the frost layer acts as a contrast suppressing unit that suppresses optical perception of the vision of the background, inhomogeneous emission of the light source, visual appearance of internal structure of the lighting system. Providing a frost layer may overcome the technical problem of the breakthrough reduction above described.

It was further realized that, in some embodiments, an observer may be brought to perceive essentially three main elements when looking at the lighting system: the bright sun-imitating area/peak, the uniform luminance sky-imitating (blue) background, and the direct surrounding of the sky-imitating background. It is noted that the overall effect of the herein disclosed lighting systems may resemble an open window through which the sky and the sun are seen.

Furthermore, it is was realized that in the reflective configuration—in contrast to the transmissive configurations mentioned above—the light beam may extend laterally beyond the sky-imitating background, i.e. onto the surrounding of the sky-imitation. Thus, the light beam may—in addition to the scattered light of the sky-imitating (blue) background—affect the visual perception of that direct surrounding such that also the impression of sky-sun-imitation can be distorted. Thus, it was realized that special care to form any visual impression of such a light beam based illumination of the direct surrounding of the sky-imitating background may increase the effect of widened perception.

As one type of a specifically adapted configurations, it was realized that one may introduce a diffuser that is subject to the diffuse light. The diffuser may have, for example, a white or generally any clear and/or bright and/or homogeneous color. In addition, the diffuser may be positioned in the (direct) beam path of the light emitted by the light source and/or in the beam path of the reflected light. In such a configuration, that direct surrounding of the sky-imitating background may appear more or less homogenously bright. Depending on the structural orientation, the diffuser may be designed as a white wall that forms a lightwell appearance around the sky-imitating background (which, in dependence of the observation direction, may have the bright sun-imitation therein). As a result, the direct surrounding of the sky-imitating background may be configured not to counteract the depth perception and in particular it may be configured such that any light incident onto it does not significantly counteracts the depth perception.

In the following, exemplary configurations of lighting systems are described, where in particular in connection with FIGS. 1A to 2B the general concept of reflectors being essentially curved in only one direction (i.e. trough-like, in connection with FIGS. 3A to 5 modular configurations, and in connection with FIGS. 6A to 6C the aspects of perception are described. Exemplary configurations of light sources are then described in connection with FIGS. 7A to 10B. In connection with FIGS. 11A to 12, an exemplary configuration of a one dimensional broadening element is described. Thereby, features of similar function or characteristic are referred to by similar reference numerals. However, the skilled person will acknowledge that embodiment specific differences may apply.

FIGS. 1A to 2B illustrate exemplary overall configurations of lighting systems 100A, 100B addressing the above objectives and in particular aspects of the light propagation within those lighting systems 100A, 100B.

Lighting systems 100A, 100B comprise a light source 102, respectively, that is configured to emit light having wavelength distributed essentially over the visible spectral range, and a reflective surface 104.

The overall design is such that light source 102 extends linearly in one direction (herein referred to as longitudinal or X-direction) essentially from one side of the lighting system to the other side, while light source 102 extends in an orthogonal direction to the longitudinal direction (herein referred to as transverse and Y-direction) only over a portion of the extent of the lighting system.

Generally, light source 102 can be, for example, a cool white light source. Exemplary embodiments of light sources may comprise LED based light emitters or discharge lamp based light emitters or hydrargyrum medium-arc iodide lamp based light emitters or halogen lamp based light emitters and respective optical systems downstream of the respective light emitter.

Figure 1B:
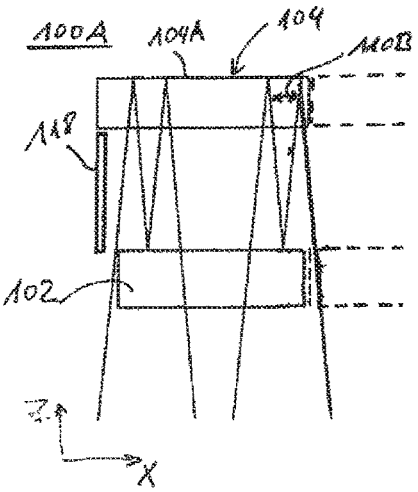
Figure 2A:
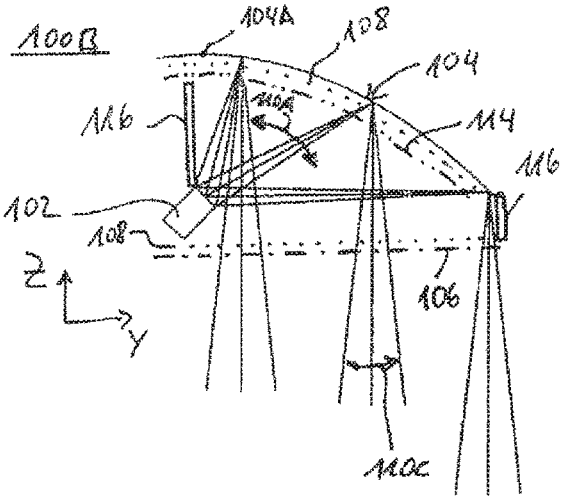
FIGS. 2A and 2B are schematic illustrations of an exemplarily lighting system for sun-sky-imitation with a half-trough-like reflector element with a displaced light source.
Figure 2B:
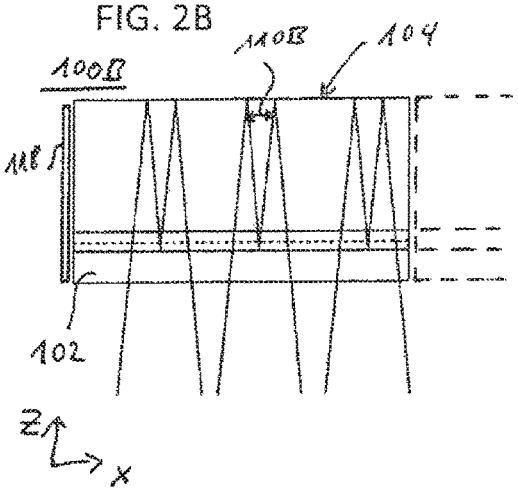

FIGS. 1A and 2A illustrate schematic cut-views through lighting systems 100A, 100B, respectively, in the Y-Z-plane, while FIGS. 1B and 2B illustrate schematic cut-views through lighting systems 100A, 100B, respectively in the X-Z-plane.

Reflective surface 104 extends essentially over the complete size of the lighting systems 100A, 100B in the X-Y-plane. However, as shown in the cut-views FIGS. 1A, 2A, reflective surface 104 is curved along the Y-direction, while it is linear along the X-direction. This one dimensionally curved configuration is referred to herein also as a linear/curved shape.

Moreover, lighting systems 100A, 100B have a thickness in a vertical Z-direction needed for illuminating the reflective surface. Specifically, the light is emitted from an exit side of light source 102. The exit side has a plurality of light emitting regions associated with respective light emitting units. The light from each light emitting region is emitted within an essentially similar emission solid angle such that all light emitting regions together form a light beam that then illuminates reflective surface 104.

In the embodiment shown in FIGS. 1A and 1B, reflective surface 104 is configured as a parabolic reflective surface having its largest curvature in Y-direction running essentially centrally across lighting system 100A along a line 104A in X-direction. In contrast, in lighting system 100B, line 104A runs essentially along a side. Accordingly, line 104A is in FIG. 1A positioned with respect to the light source 102 for illumination with a central portion of a light beam strip and in FIG. 2A positioned next to, e.g. within or outside of, a border portion of a light beam strip (light beam strip 220B shown in FIG. 3A). It is noted that for a parabolic shape of curved reflective surface 104, line 104 includes the symmetry points of the respective parabolas.

Light sources 102 are positioned in or at least next to the corresponding focal line of the parabolic shape. Thus, illuminating reflective surfaces 104 from below will result in a beam propagating essentially downwards after being reflected by reflective surface 104 such that a "sun" image is perceived at the zenith. However, for lighting system 100A, light source 102 runs centrally along the linear set-up, thus blocks a central line of lighting system 100A. In contrast, for lighting system 100B, light source 102 is at the side of the reflected light beam and the light beam may extend up to the side opposite to light source 102 of lighting system 100B.

As will be described in connection with FIG. 4, that extension in Y-direction to one side allows mounting two systems of the type of lighting system 100B side by side such that two coupled parabolic surfaces (with distinct separate light sources) can be used to extend the illuminating size in Y-direction.

As pointed out above, for both configurations, light source 102 and, thus the reflected light beam, extends essentially from one side of the lighting system to the other side. Accordingly, a—in principle—freely selectable number of lighting systems (of the same type) can be arrayed in X-direction (indicated by dashed lines at the right side in FIGS. 1B and 2B), thereby extending the reflective surface and increasing the light beam size.

Thus, the configurations allow a modular concept for scaling the size in of the compound lighting configuration in X-direction without a discontinuity of the shape of the overall reflective surface. The doubling of the size in Y-direction for the second embodiment of lighting system 100B is—in contrast—connected with a discontinuity in the surface along the border (see also FIG. 4).

Any transition between neighboring modules may nevertheless introduce some local change in appearance. Such a change in appearance may, for example, be reduced or even removed by introducing forward scattering in the output beam. For example, a so called diffuser, e.g. a coarse grain diffuser, may be provided as an output window that extends across any transition.

Figure 5:
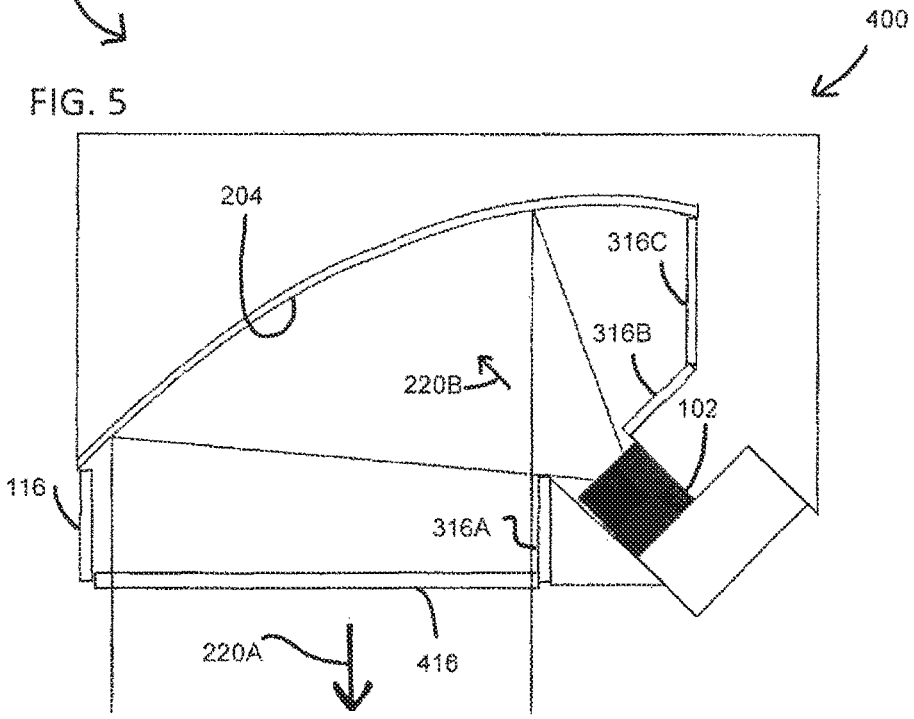
FIG. 5 is a schematic illustration of a further exemplary lighting system module with a light-well/frame implementation.

In some embodiments, such a (coarse grain) diffuser 106 (schematically indicated in FIGS. 1A and 2A by a dashdotted line) may be positioned below the light sources or between light sources as shown in FIG. 5. In one embodiment disclosed in FIG. 1A, two (coarse grain) diffusers 106, for example two frosted glass panels, may be mounted to connect light source 102 with the border of reflective surface 104 in a V-shape embodiment. In another embodiment, the diffuser 106 extends below light source 102.

A coarse grain diffuser 106 may have a continuous coarse grain surface formed by a plurality of mosaic-like surface structures with a plurality of surface sections for interacting with the light beam. The mosaic-like surface structures may comprise faceted structures based on geometric shapes, for example polyhedron-like shapes such as prism-like shapes, pyramid-like shapes, wedge-like shapes, and cube-like shapes, wherein the faceted structures extend from or reach into the continuous coarse grain surface. The faceted structures may comprise rounded transitions of adjacent facets and/or curved facet surfaces A correlation area of the mosaic-like surface structures is selected to provide for a fragmentation of the vision of the light source exit area when seen along an optical path including the continuous coarse grain surface. The plurality of surface sections are configured to redirect incident light beam portions such that the light beam downstream the continuous coarse grain surface is broadened in size, the illuminance values on an observer area are reduced, redirected light beam portions exhibit local luminous peaks with a luminance comparable to the luminance of the emitting surface, and/or scattered ("blue") light is perceived around redirected light beam portions. The mosaic-like surface structures of the coarse grain diffuser may be arranged partly regular, irregular, or random-like with respect to shape and orientation on the continuous coarse grain surface.

The correlation area of the mosaic-like surface structures (i.e. the average transversal size of the single mosaic-like surface structure, essentially comparable in size to the size of the surface section, is defined by one complete surface oscillation) is in the range from about 0.5 mm to 2 cm, and is in particular selected such that mosaic-like surface structures are resolvable by eye in a distance range associated with an observer of the illumination system (e.g. distance larger than 1 m or 5 m).

Referring again to FIGS. 1A and 2A, the sky-sun-concept is based on the introduction of Rayleigh-like scatterer into the optical beam path in line with the above illustrated considerations. The light scattering in a regime close to Rayleigh scattering in the visible spectral range results in a chromatic separation between a non-scattered transmitted portion of the incoming light beam and a (Rayleigh-like) scattered diffuse light portion. Thereby, a blue diffused light component at large propagation angle and an image at infinity of the light source as the sun may be perceived.

The chromatic separation and the generation of the bluish (higher CCT) diffuse light can be achieved with the use of a "thin" layer or a "thick" panel that respectively include the required amount of scatterer per unit area (herein generally referred to as a chromatic diffusing layer 108). Such a layer can be a film or a coating applied to the reflective surface. In other embodiments, the layer may be applied to another interface extending across the beam, or a panel may be provided in proximity to the curved reflector, or detached from the curved reflector as long as the light exiting the lighting system has pass through the chromatic diffusing layer 108 before exiting the lighting system. Two exemplary positions of chromatic diffusing layers 108 are schematically illustrated as dotted lines in each of FIGS. 1A and 2A.

FIGS. 1A to 2B further illustrate the underlying two-stage concept in the light collimation, specifically in Y-direction. In the exemplary embodiments shown in FIGS. 1A to 2B, light source 102 is designed to have a narrow angular divergence emission along one direction (X-direction) and a broad angular divergence along the transverse direction (Y-direction).

The two-stage collimation is achieved with an optical system (the first stage) being part of light source 102. The optical system of light source 102 is on the one side configured to provide the required collimation along X-direction. For example, LED light (as an example of a primary light source) is being collimated along one direction, herein exemplarily referred to as (longitudinal) X-direction. The optical system may provide a larger divergence, i.e. a reduced collimation in the (transverse) Y-direction, for example with a uniform intensity distribution. In FIGS. 1A and 2A, the large divergence in Y-direction is indicated by arrows 110A, while the low divergence in X-direction is indicated by arrows 110B in FIGS. 1B and 2B. In connection with FIGS. 7A to 12, exemplary embodiments of optical systems are described. Those optical system may also allow formation of a quite sharp cutoff of light emission along X- and Y-directions, which may avoid or reduce stray light originating from the surrounding of the curved reflector.

For the collimation along Y-direction, a second stage is provided by the curvature of reflective surface 104 that collimates the light output (having a large difference in the divergence for X- and Y-directions) from the light source in the transverse Y-direction. The reduced divergence in Y-direction is indicated by arrows 110C in FIGS. 1A and 2A.

The curvature of reflective surface 104 may be selected such that the resulting final light emission is collimated along both directions, X- and Y-direction in a, for example, similar manner, e.g. within a factor of three. The collimation in both directions corresponds to the collimation of the "sun" imitating component. Accordingly, angular beam divergences downstream the reflective surface should be in the range from 0.5° to 20°, e.g. 3° to 15°. Accordingly, a respective divergence is already provided by the optical system in the X-direction, while the optical system can provide an angular beam divergence upstream the reflective surface in the transverse direction in the range from 300 to 160°, e.g. from 40° to 140° such as from 50° to 120°.

The reflective surface can, for example, be provided by a curved reflector such as a trough-like reflector having a parabolic shape in Y-direction. The curved reflector then provides a focal line that may be arranged to correspond to an exit surface of light source 102. The collimation along Y-direction is then given by the ratio between the size along Y-direction of the exit surface of light source 102 and a focal length of the parabolic reflector in Z direction.

In general, the reflective surface may be formed to have a concave, half-cylinder-like shape along Y-direction like a parabolic concave cylindrical mirror. The reflective surface is configured to collimate the light rays of the light source only in the plane orthogonal to the X-direction, i.e. the plane along Y-direction. The effective focal length of, for example, the parabola may be selected such that the output angular divergence along Y-direction is roughly 10° and thereby, for example, abut or equal to the divergence in X-direction that may be dictated by the CPC geometry (design of the optical system of the light source).

In contrast, the divergence in X-direction is not effected by the curved reflector because the light emitted by the light source is regularly reflected by the curved reflector (being essentially linear in X-direction) and retains its divergence stemming from the light source. Accordingly, the light source is configured to show a sun-like low divergence in the X-Z-plane and to produce a luminance angular profile along X-direction that in its width can match the width of the reflected and collimated luminance in the Y-direction.

The light source may have a luminance which substantially does not depend on the X-coordinate to be essentially uniform along the X-direction, and that generally depends weakly on the azimuth angle in Y-direction but shows a narrow peak with respect to its dependence on the axial angle in X-direction. For example, said luminance angular profile may have a FWHM (full width at half maximum) larger than 60°, such as larger than 90°, or even larger than 120° with respect to the dependence on the luminance profile in Y-direction, and have a FWHM smaller than 45°, such as smaller than 30°, or even smaller than 15° with respect to the dependence on the luminance profile in X-direction and the axial angle.

In the following, measures are illustrated that may ensure the sun-like appearance, by, for example, introducing additional scattering elements. The first measure is an introduction of the previously addressed forward scatterer. The second is an introduction of framing surfaces that in particular may result in a lightwell appearance such as a blue sky seen through an opening in the ceiling.

The first measure in particular addresses a rectangular or square geometry underlying the primary light source. Such a geometrical constraint of the primary light source may create in general a "sun" image that is not circular as, for example, the angular distribution after the two-stage collimation will be perceived as a square-shaped sun.

The perceived shape can be modified by introducing a layer of low-angle white light diffusing frost such as a transmitting paint layer at a surface or interface through which the beam passes. For example, it was realized that a 7° FWHM diffusing paint can convolve a 10°×10° square shape into an almost as round perceived shape. In some embodiments, an improvement for what concerns the generation of a round symmetric angular divergence of the light reflected by the chromatic reflective surface is obtained by providing onto the chromatic reflective surface a low-angle white-light diffusing layer. The low-angle white-light diffusing layer acts as a low-band pass filter and, therefore, blooms any image, including the image of the source, by convolving it with a circularly symmetric function.

Such a low-angle white light diffusing frost layer also may avoid that the "sun" image is perceived as deforming towards the boarder of the curved reflector. Due to the curvature in Y-direction, the effective dimension of the light source as seen from the parabola is changing due to the larger distance between the reflecting surface and the light source. The convolution of the low-angle scattering may strongly reduce the change in the output angular beam.

Furthermore, the use of a low-angle frost may reduce the luminance of the "sun" image, therefore the "sun" will appear less bright than in the case without frost.

In addition, due to the extent of the exit surface of light source 102 as well as deviations of the curved shape from a parabolic shape, the light beam characteristic may not be completely shift invariant in Y-direction, e.g. associated main propagation directions may vary over the extent of the beam in Y-direction.

In general, exemplary positions of such a forward scattering layer are similar to the positions of coarse grain diffuser 106 indicated in FIGS. 1A and 2A. For example, a forward scattering layer may be provided as or in addition to the above mentioned (coarse grain) diffuser 106. In some embodiments, the forward scattering layer may be incorporated into a reflector unit providing the reflective surface, in some embodiments together with the chromatic diffusing layer (as indicated in FIGS. 1A and 1B by dash-double dotted lines 114).

The second measure relates to smoothing out the illumination and/or providing a constant illuminated impression next to the sky-imitation.

Herein the measure is explained based on a diffuser structure 116, herein also referred to as lightwell white diffuser or white diffusing wall element. Diffuser structure 116 may be introduced to cover zones within lighting systems 100A and 100B that may have a problematic appearance such as insufficient illumination as the light from light source 102 may not reach those zones. Moreover, those zones may be subject to stray light from various interfaces such as a coarse frost panel.

Selecting a, for example, white appearance of the diffuser can create a contrast of its color with the "sky" portion just next to them. This can in particular emphasize the sky appearance, when the bordering portion of the nanoparticle-coated reflective surface is not illuminated as intense as the central portion. This is because e.g. the light intensity decays towards the border of the angular divergence along Y-direction such that those border zones just next to the white diffusers have a lower luminance than in the upper/central portion of the reflective surface. That area may accordingly appear in a "grayish" blue. The contrast of color created with the white diffuser may enhance the effect of the blue and at least partially correct the appearance.

In some embodiments, the white diffuser wall(s) may not be illuminated by the direct reflection from the parabola, or they are illuminated by this component only at a very low grazing angle. However, those white diffuser walls are illuminated mostly by the blue diffuse light, by any back-reflection from a downstream panel, and by stray light directly coming from light source 102.

A frost panel positioned in the reflected beam and "hiding" also the white diffuser, e.g. being position at the exit face of the lighting system, will make different "sky" luminance and colors between various from an observer less visible.

As schematically indicated in FIGS. 1B and 2B, in X-direction, a wall 118 may be configured for similar reasons as a white scattering wall or as a wall with a nanoparticle-coated reflective surface to extend the sky.

The diffuser structure or diffusing wall element is necessary to white, but it may have, for example, a white or generally any clear and/or bright and/or homogeneous clear color.

In the following, a lighting system module 200 is described in connection with FIGS. 3A to 3C that allows formation of an enlarged sky area by arraying a selectable number of modules in X-direction. Moreover, in Y-direction a pair of modules can be provided as discussed in connection with FIG. 4.

Lighting system module 200 comprises a mount 210 as a support structure for holding various components of lighting system module 200, such as light source 102, a cooling unit 212 for cooling light source 102, an ornamental cover 214 covering the mounting area of light source 102, and a diffuser panel 216 that defines essentially an exit aperture of lighting system module 200.

Mount 210 provides a reflective surface 204 that faces the exit aperture of light source 102 and is configured in the desired shape for collimating the light in Y-direction but essentially only reflect the light in X-direction, i.e. it is linear and curved in X- and Y-directions, respectively, as described above. Specifically, in Y-direction, surface 204 may have a parabolic surface that is displaced with its center point 204A at a light source side area of mount 210.

Moreover, the Rayleigh-like diffuser material generating the artificial "sky" luminance may be a coating on reflective surface 204, a separate panel downstream reflective surface 204, and/or even integrated into diffuser panel 216. Generally, the curved reflective surface 204 may be made of specular aluminum foil such as Alanod Miro 27 foils. The foil may be applied to the curved surface in particular parabolic shape by mount 210 forming, for example, a metallic (e.g. aluminum or steel) holding frame, or the reflective surface 204 may be configured as a self-supporting structure.

In the displaced configuration, light source 102 is displaced from the exit aperture and not in a central position. Therefore, it does not occlude a portion of a light beam 220A exiting the inner of lighting system module 200 through the exit aperture, and thus the efficiency of lighting system module 200 is increased as essentially all light of internal light beam 220B enters the to be illuminated ambient room. In other words, the displace configuration enables further a continuous exit aperture with a total width comparable to the linear/curved surface.

In the displaced configuration, when looking from below at the lighting system, light source 102 is positioned in front of the light source side portion of the reflective surface. In the case of the reflective surface being combined with the chromatic diffusing layer, that portion may be subject in reduced homogeneity of the illumination. As can be seen in the cross-sectional views, light source 102 reaches into the inner chamber of the lighting system. Thereby, it blocks at the one side the direct view of a potentially not perfect sun imitation. From the other side, the configuration provides a larger sky imitation area, i.e. an extended reflective surface 204 in Y-direction above the source so that the observer is able to look around/beyond light source 102. Therefore, light source 102 is used as a beam block by occluding a pocket-like portion, which extends "behind" light source 102, of the sky from direct view of an observer being position below light source 102.

Figures 3A, 3B, 3C:
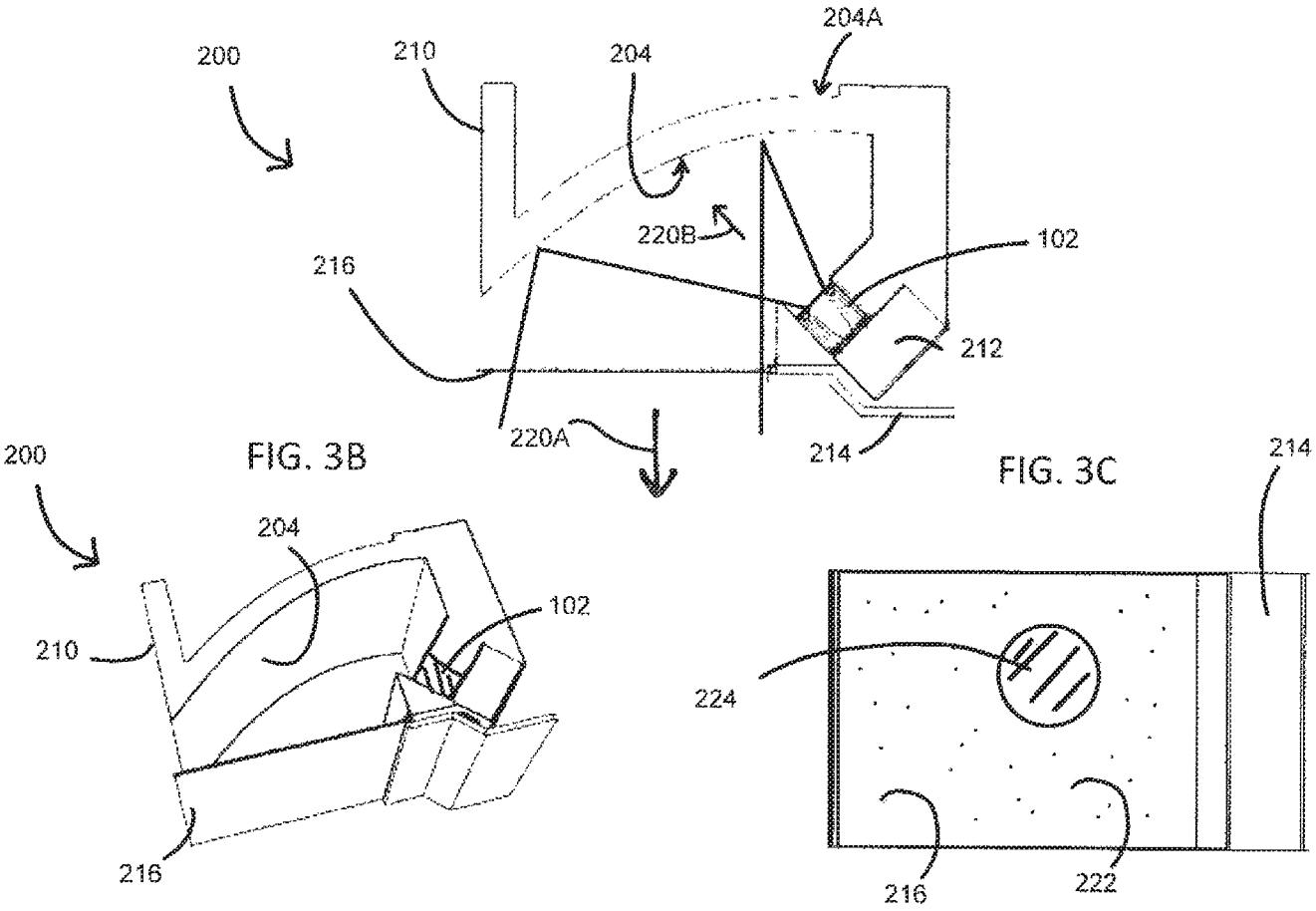
FIGS. 3A to 3C are a side view, a 3D view, and a bottom view, respectively, of an exemplary lighting system module with a half trough-like reflector element with a displaced light source.

FIG. 3C illustrates a bottom view of lighting system module 200 for an observer being within light beam 220A. The observer will see ornamental cover 214 at the light source side. Next to ornamental cover 214, diffuser panel 216 will be received as a window towards the sky (the blue diffuse light indicated by dots 222) in which the aperture of light source 102 reflected by reflective surface 204 will be received as the sun (the yellow direct light indicated by shaded circle 224).

It is noted that the displaced configuration may have a less uniform illumination of the reflective surface, which, in the case in which the reflective surface is coated by a Rayleigh-like diffuser material, determines a slight dis-uniformity of the artificial "sky" luminance.

Moreover, the output angular divergence along Y-direction, i.e. the direction along which the light beam is collimated by the e.g. parabolic mirror may slightly change from point to point across the parabola, i.e. along the Y-axis. The white light low angle diffusing frost effect of diffuser panel 216 may reduce that change because it convolves the angular output from the parabolic mirror. In addition or alternatively to diffuser panel 216, a diffusing layer may be placed on the reflective surface itself. Furthermore, the coarse frost mentioned herein—being e.g. a separate layer as the exit window of the lighting system module—can have the same beneficial effect In general, there may be some illuminance modulation within the light beam. For example, lines of different illuminance may be present in the light beam due to the discrete structure of an underlying LED array constituting light source 102, and/or due to possible construction imperfection of the optical system of light source 102. For example, the refractive optical element may create, although generally less noticeable, shadow lines in Y-direction. Although a refractive optical element—as discussed, for example, in connection with FIGS. 11A to 12—may be able to wash out such a structures along Y-direction, those structures may be present along X-direction and be perceived as shadow lines on the sky. A low angle divergence frost of, for example, 2° FWHM may be used to wash out those shadow lines. A low angle diffuser may scatter in a scattering cone in e.g. a range from 1° to 15°. It could be a bulk diffuser such as micrometric particles (having a size much larger than in the chromatic diffuser, e.g. micrometer scale) embedded in a transparent matrix, or surface structures in the micrometer order (one to few microns). In addition or alternatively to providing such a frost generating scattering layer at the exit window, it may be applied, for example, on the reflective surface (introduced below) and/or directly provided with light source 102, e.g. at the outer face of the refractive optical element (introduced below), and/or at the surface facing the curved reflector. In some embodiments, it may even be incorporated in the refractive optical element itself.

Figure 4:
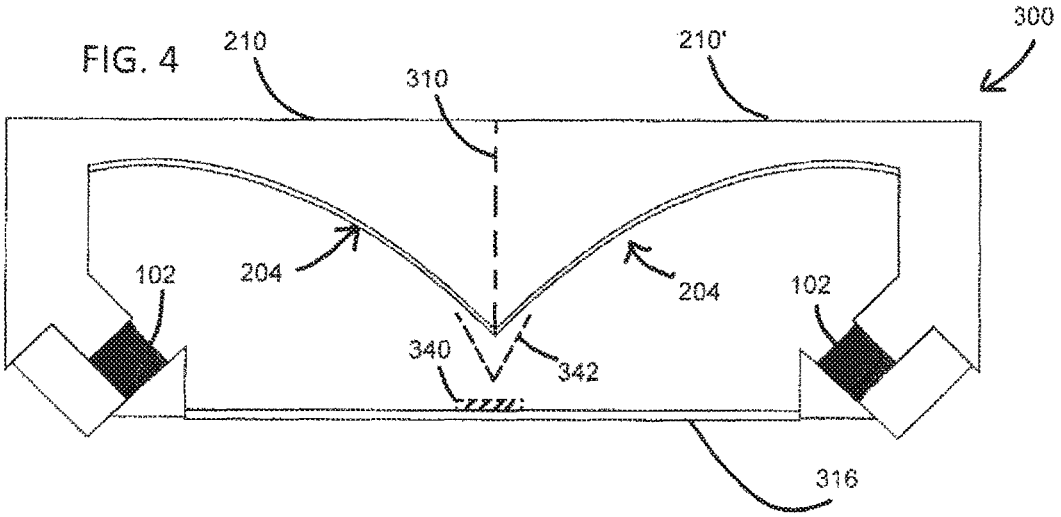
FIG. 4 is an illustration of a side-by-side arrangement of two lighting system modules of FIGS. 3A to 3C.

Referring to FIG. 4, module 200 of FIGS. 3A to 3C is combined with another module 200' of the same type such that their light source sides define opposing ends of a combined lighting system 300.

The mounts 210 can alternatively be made as one common unit as (indicated by the dashed line 310), thus forming also one single structural module with coupled e.g. parabolic surface configurations as described above.

In some embodiments, instead of small individual output windows, a common output window 316 may cover the coupled reflective surfaces 204 and may be configured as a diffuser panel. In any case, the width of common output window 316 may be about twice as large as the width of one of the coupled reflective surfaces 204.

As discussed above, the illumination conditions at the far end of each reflective surface 204 (being now in the center of output window 316) may differ from those closer to light sources 102. In some cases, a jump in luminance may be present. In some embodiments, an additional scattering layer 340 may be applied onto the exit window forming a strip extending in X-direction and being of limited width in Y-direction. Scattering layer 340 can also be absorbing or opaque as a pattern formed on the window. Additionally or alternatively, one or more diffuser walls 342 may be provided in the center. The respective structures may additionally be a mount for output window 316.

FIG. 5 shows another embodiment of a lighting system module 400 to illustrate the aspect of diffusing walls. Referring to FIGS. 1A and 2A, (e.g. white) diffusing wall element 116 is provided at the far end side of reflective surface 204. In addition or alternatively to diffusing wall element 116, diffusing elements 316A, 316B, 316C may be provided within lighting system module 400 at the light source side. The positions may in particular be subject to inhomogeneous illumination conditions due to, for example, stray light, back-reflections etc. In particular, diffusing elements 316A, 316C may be visible for an observer and contribute to the lightwell appearance like e.g. white diffusing wall element 116. Those elements 316A, 316C do not need to be white and can alternatively be, for example, nanoparticle-coated mirrors or mirror foil, or diffusing elements, e.g. of white or bright color.

In general, the modules of lighting systems of FIGS. 3A to 3C or FIGS. 4 and 5 may be mounted in a continuous layout one following the other, or as independent units re-creating a number of apertures within e.g. a ceiling. Based on the modular concept, the arrangement can be custom defined by the architect/designer depending on the project, ambience, and/or space available.

In general, the modules of lighting systems of FIGS. 3A to 3C or FIGS. 4 and 5 may have a manageable size such as extend in X-direction and Z-direction up to about 0.5 m and in Y-direction up to 1 m (the twin configuration in the one-part design may be larger). However, larger sizes may be possible. The light source configuration, in particular its thickness in Z-direction in the mounted state as well as the divergence in Z-direction that can be achieved, define those dimensions. For example, the light source disclosed in connection may allow thinner modules.

Figure 6A:
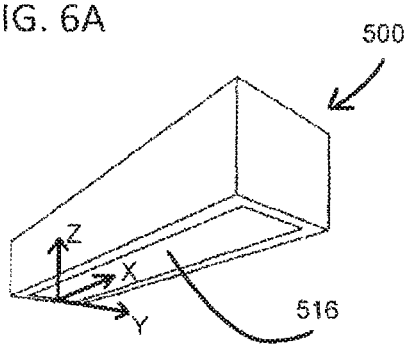
FIG. 6A to 6C are a 3D view, a side view, and a set of bottom views for schematically illustrating the visual perception of a sun-sky-imitating lighting system.
Figure 6B:
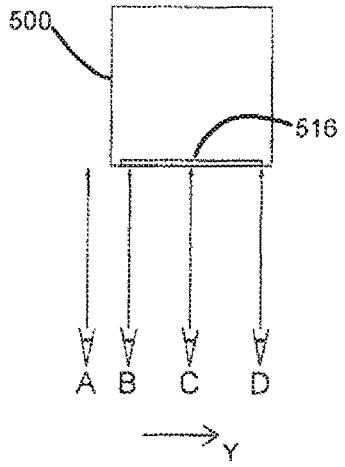
Figure 6C:
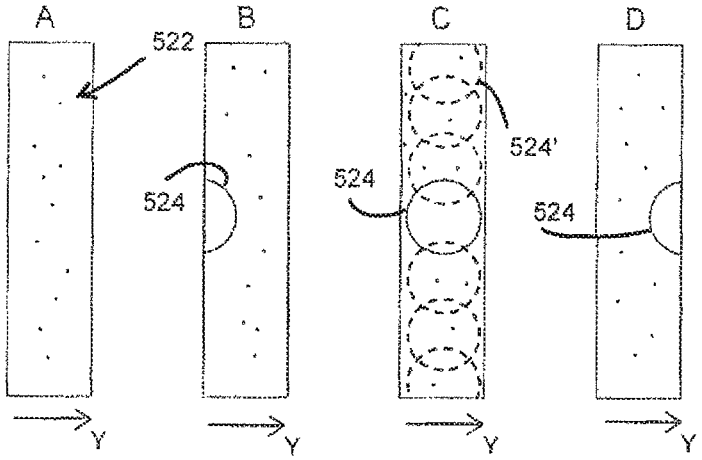

Referring to FIGS. 6A to 6C, the perception of a lighting system 500 composed of the units/modules disclosed herein by an observer is illustrated. Based on the above and including the divergence compensation of the curved reflective layer, an observer—looking directly onto the curved reflective layer being behind an exit window 516 from below and from a certain distance—sees a bright flashed area 524 under an angular aperture $\Delta\upsilon$.

FIG. 6B indicates positions A to D of the observer when crossing below lightings system 500 in Y-direction. The corresponding perception is illustrated in the respective illustration of FIG. 6C. The observer looking at the lighting system may perceive flashed area 524 as a light source at virtually infinite distance surrounded by the blue sky-like background (indicated by dots 522). This breakthrough effect of infinity can occur when lighting system 500 is designed to let the observer interpret the feature in the foreground (e.g. a structure at exit window 516) as characteristics of the window itself, while considering the flashed area and the surrounding blue sky-like background coming from infinity.

Looking at exit window 516 from outside light beam 220A, the observer sees only the diffuse light from the Rayleigh-like scattering (FIG. 6C; section A). When moving into light beam 220A, the observer sees first a portion of (sun-like) flashed area 524 appearing (FIG. 6C; section B), then complete flashed area 524 (FIG. 6C; section C), which thereafter disappears again (FIG. 6C; section D).

Similarly, as shown in FIG. 6C (section C), an observer walking along X-direction within light beam 220A will similarly observe flashed area 524' as a sun appearance following his movement (dashed circles indicating flashed area 524').

The angular width under which the observer sees flashed area 524 does not depend on the observer-source distance anymore but only on the width of the source in the Y-direction and on the focal length of the parabolic reflective surface. For example, a focal length of about 0.30 m leads, in the ideal condition, the observer to perceive the flashed area under an angle of about 10° in Y-direction, for a e.g. 0.05 m width of the linear light source in Y-direction. The angular width under which the observer perceives the flashed area in the X-direction is not modified by the presence of the curved reflector (due to the infinite focal length in the X-Z-plane), leading therefore to also perceiving the flashed area under an angle of about 10° in X-direction (assuming a respective optical design of the light source). This means that, for any observatory-source distance, and for a given source width in the Y direction and source Luminance profile, the condition of substantially isotropic or at least not-elongated appearance of the source flashed area, i.e. the condition $\Delta\upsilon_X=\Delta\upsilon_Y$, can be met by properly choosing the parabolic mirror focal length. Therefore, the herein disclosed concepts allow producing the appearance of a sun image equally wide along X-direction and Y-direction based on a lighting system that may have an arbitrarily large length in X-direction.

In other words, the above mentioned factors, such as the focusing power in the Y-Z-plane, the anisotropic angular luminance profile of the lighting source, the uniformity of said angular luminance profile in X-direction, the cylindrical parabolic shape and the position of the light source at or about at the mirror focal line, and, last but not least, the capability of scattering the short wavelength of the impinging light, concurrently contribute in creating the appearance of a blue sky and a bright sun spot at infinite distance, wherein the size of the produced sky window along X-direction can be made arbitrarily large.

For completeness it is noted that a so-called coarse grain diffuser may in addition or alternatively be used to affect the perception of the beam divergence by a coarse grain structure at an interface based by the light beam. At large angles, the blue diffuse light is transmitted essentially unaffected by the coarse grain diffuser. However, at low angles the image of the "sun" is shattered inside the grains constituting the coarse grain diffuser. Inside each grain, the peak luminance is the same as the one of the original "sun" image. The global effect is similar as seeing the sun through a frosted glass such as those used in bathrooms or shower boxes. As in the case of a low-angle white light diffusing frost layer, also the coarse grain diffuser avoids the perception of a deformed "sun" image.

Figure 7A:
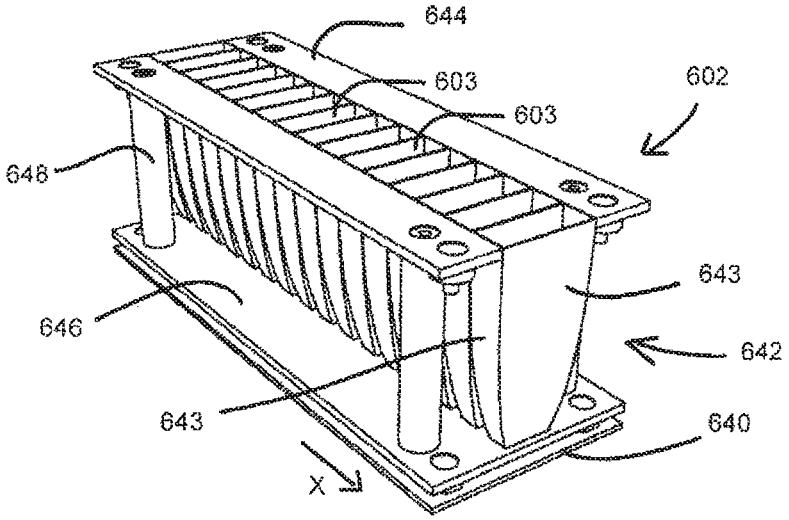
FIG. 7A is a subunit of a light source based on CPC elements.
Figure 7B:
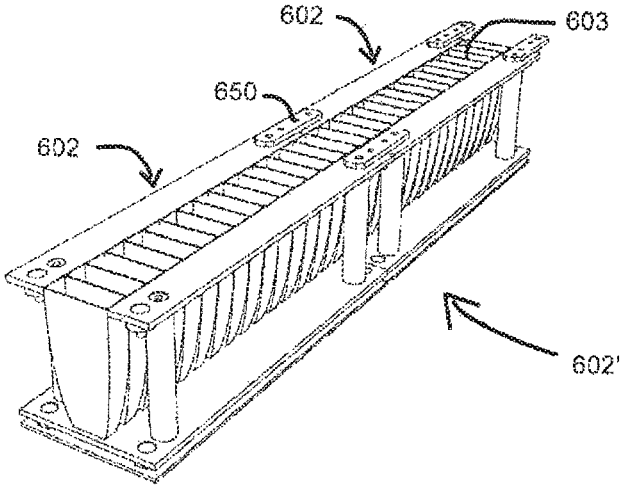
FIG. 7B is an illustration of two subunits of FIG. 7A forming an exemplary linear light source.

FIGS. 7A and 7B show an exemplary construction of a linear light source 602 comprising a plurality of light emitting units 603 and extending in the mounted state along X-direction. Specifically, light source 602 comprises an electronic board 640, a linear array of primary light emitting units based on emitters mounted on electronic board 640 and supplied and controlled by electric circuits within the board. For sun-sky imitation embodiments, the primary light emitting units are configured to emit light over the visible range to include essentially all wavelength of the visible sun spectrum or at least sufficiently broad spectrum to allow sun imitation.

Light source 602 comprises further CPC (compound parabolic concentrator) reflectors 642 as an example of an optical system for collimating the primary light.

Each emitter comprises, for example, an LED arrangement with one or more LEDs such as a rectangular white light LED, e.g. a sequence of, for example, in Y-direction arranged LEDs. The LEDs may be placed in a linear array of groups along X-direction. Inside each group, the LEDs are abutting each other along Y-direction.

LED arrangements may have LED emitting areas that are, for example, arranged side by side to form an LED strip and, thus, form a rectangular zone that emits light interrupted by dark lines in-between LED emitting areas.

The light of an LED arrangement is collected and collimated by the respective optical system, i.e. CPC reflectors 642, emitting light at its output side. CPC reflectors 642 are formed respectively by two pairs of parabolic reflecting facets 643 (so-called rectangular CPC reflector) and are optically coupled with their respective LED arrangements to reduce the divergence in the X-direction and the Y-direction to, for example a divergence of 10° in X-direction and a divergence of 30° in Y-direction, i.e. a full angular aperture of 10°×30°.

The LED arrangement is configured to input in a CPC input side as much as possible primary light but any dark left over space will modulate the output beam of CPC reflector 642, which in some embodiments may be compensated by a frost effect provided at some distance from the output side of CPC reflector 642. Those dark lines may be received in the light beam as shadow lines transformed into modulations in the blue "sky" generated by Rayleigh-like scattering. In order to wash out such structures, a white light narrow angle frost sheet can be applied to cover the exit faces of the whole CPC array, i.e. in particular also covering the lateral exit of those cut-open CPCs described below in connection with FIG. 8.

Referring again to FIG. 7A, CPC reflectors 642 can be arranged parallel to each other in a line along X-direction so that the long edge of the output side of one CPC reflector 642 is in contact with the long edge of the output side of the next CPC reflector 642. This allows to maintain a, for example, 10° (full angle) divergence along X-direction, while at the same time keeping a small lateral output face aperture along the transverse Y-direction.

CPC reflectors 642 may be made of aluminum with high reflection efficiency (e.g. reflection of about 98%).

The module may comprise positioning and shape preserving elements for the correct operation and alignment of the CPC reflectors. In some embodiments, light source 602 may comprise at least one mounting plate for alignment of the plurality of CPC reflectors. For example, as shown in FIG. 7A, an outlet mounting plate 644 comprises a single mounting opening, which is adjusted to the arrangement of the plurality of CPC reflectors 642. An inlet mounting plate 646 comprises a mounting opening for each of the plurality of CPC reflectors 642. Several distance holders 648 mount inlet mounting plate 646 and outlet mounting plate 644 at a respective distance and relative orientation.

Referring to FIG. 7A, light source 602 can be considered a linear illuminator or projector that generates a light beam extending in X-direction. Light source 602 can be positioned at or close to the focal line of curved reflective surface as described above, in order to more or less completely illuminate the same.

FIG. 7A schematically shows a module configuration for an LED and CPC-array based light source module. Specifically, the schematic design of the LEDs and CPCs array may form a module of a length of, for example, about 0.25 m.

A series of such modules as shown in FIG. 7A can be mounted one after the other to obtain a single elongated light source 602' with a length of the order of meters. One or more modules may be associated with one curved reflector and several curved reflectors may form a combined lighting system installation. A respective set of two light sources 602 is shown in FIG. 7B connected by mounts 650.

A CPC configuration providing the e.g. 30° full aperture angle in Y-direction may be not divergent or require a too large distance to completely illuminate a large portion of the reflective surface 104, 204. For example, if a large output surface of the lighting system is intended, a large curved reflector along Y-direction is required such that a 30° aperture would illuminate only a small portion of such curved reflector.

Besides increasing the distance or adapting the reflector size, two approaches are described in the following that allow a larger divergence in Y-direction.

Figure 8:
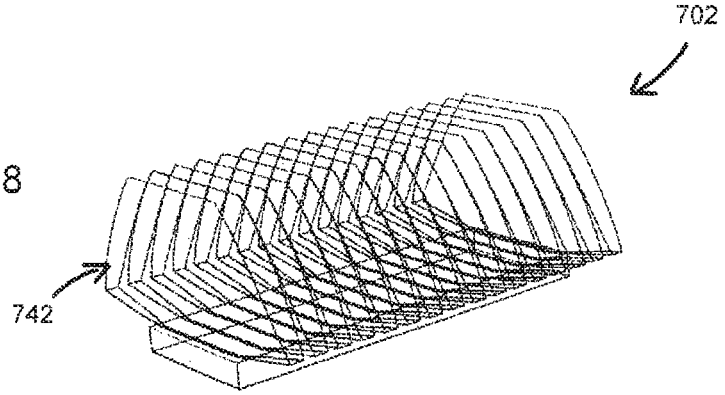
FIG. 8 is a subunit of a light source based on one-sided open CPC elements.

The first approach is based on a modification of the shape of the rectangular CPC reflectors in Y-direction. A sequence of exemplarily modified broad CPC reflectors 742 forming an optical system for a light source 702 is shown in FIG. 8. Specifically, for example, a 10°×100° CPC reflectors may be (very) elongated along the Y-direction. By allowing a certain amount of non-collimated light to pass through, the CPC reflector can be cut so that the lateral dimension is less elongated.

Although broad CPC reflectors 742 as illustrated in FIG. 8 may provide an angular divergence along the transverse Y-direction that illuminates the complete curved reflective surface in Y-direction, it widens the effective source seen by the curved reflector. In some embodiments, this may result in a larger output angle divergence from the curved reflector along Y-direction such that a series of possible ghost images may appear in the light beam. Moreover, the broad CPC shape may provide a light distribution that may not be sufficiently uniform and may not exhibit a sharp cut-off along Y-direction. The first may be addressed by respective homogenization of the light and the second may be addressed by respective apertures in the lighting system configuration.

In some embodiments, an LED may comprise a dome lens such as, for example, a cylindrical lens for reducing the divergence in the X-Z-plane. In some embodiments, a primary emitter comprises an LED and a total-internal-reflector (TIR) lens instead of a CPC reflector 62, or a combination of a TIR lens and a CPC reflector.

Figure 9A:
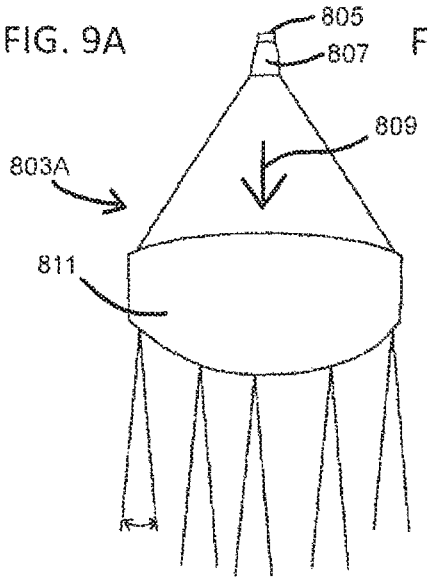
FIGS. 9A and 9B are schematic illustrations of lens based elements for use in a subunit of a light source.
Figure 9B:
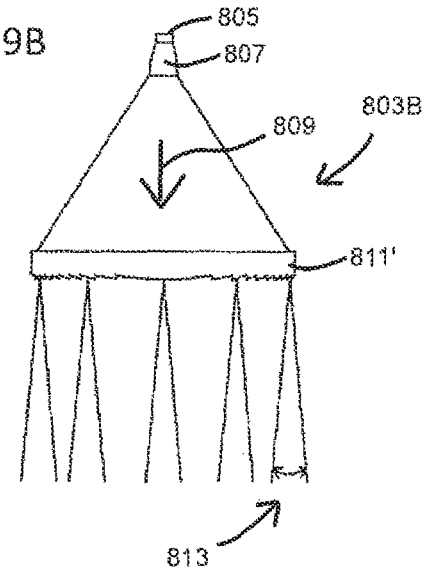

FIGS. 9A and 9B are schematic cross sections of exemplary primary light emitting units 803A, 803B for a compact light source, herein referred to as LED-CPC-lens unit. Specifically, the light of an LED 805 is collimated by a CPC element 807 acting as a first concentrating element. A collimated output beam 809 is further collimated by a conventional collimating lens 811 (FIG. 9A), or a Fresnel lens 811' (FIG. 9B). This configuration projects at infinite distance (far field), by means of lens 811, 811', the shape of the output surface of the first concentrating stage, or the shape of the LED if no first concentrating stage is used. The final divergence is square-shaped with angular width given by the ratio between the output face aperture and the lens focal length if the CPC output face, or the LED, is square.

In some embodiments, the CPC in the LED-CPC-lens unit may be substituted by another collimating element such as a dome lens or a total-internal-reflector (TIR) lens or a field lens.

In some configurations, the output divergence 813 may be rotational symmetric, e.g. round-shaped, or at least comparable in X-direction and Y-direction. A refractive element may then be used to enlarge the divergence in Y-direction e.g. up to 100° or more (see FIGS. 11A and 11B). In other embodiments, the LED-CPC-lens unit is itself configured for respective asymmetric beam divergences.

In some embodiments, the LED-CPC-lens unit have a square or rectangular shape and, thus, allow forming an array of a plurality of LED-CPC-lens units without much dark—non-illuminating—areas.

Figure 10A:
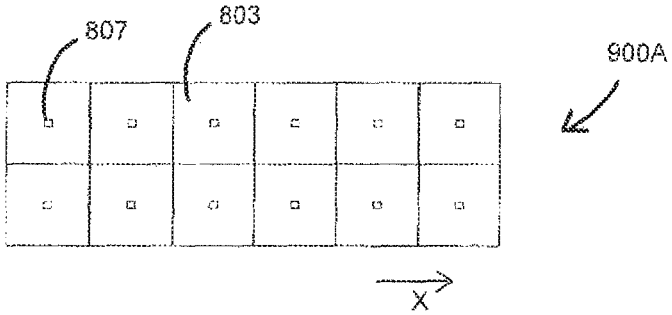
FIGS. 10A and 10B are schematic illustrations of aligned and displaced arrangement of, lens-based elements such as shown in FIGS. 9A and 9B.
Figure 10B:
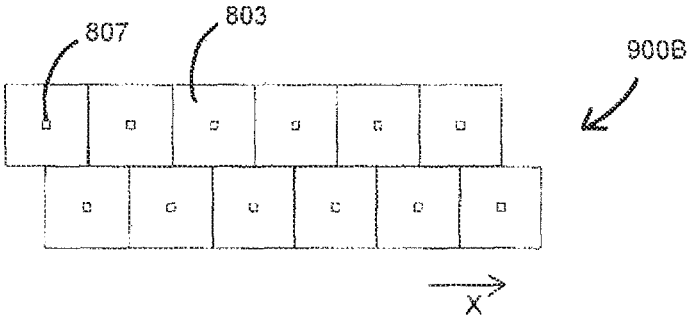

A plurality of LED-CPC-lens units may be placed side by side along Y-direction in groups of two or three units that are then placed as a linear array along X-direction. For example, the embodiments of FIG. 10A illustrates a symmetric array configuration 900A, while FIG. 10B illustrates an array configuration 900B in which one of the few (such as two or three) LED-CPC-lens units placed side-by-side along Y-direction, constituting the groups which are placed in a linear array along X-direction, is displaced along X-direction for neighboring rows such that the result is an alternating pattern, reducing, for example, shadow line symmetry.

In general, the CPC shape for the LED-CPC-lens units may also be a round CPC, for example further corresponding to a round LED. Although such a configuration may reduce the uniformity on the parabolic mirror, the resulting sun image after the collimation by the parabolic mirror may be more round than it would be under similar situations for the case of square CPCs.

Figure 11A:
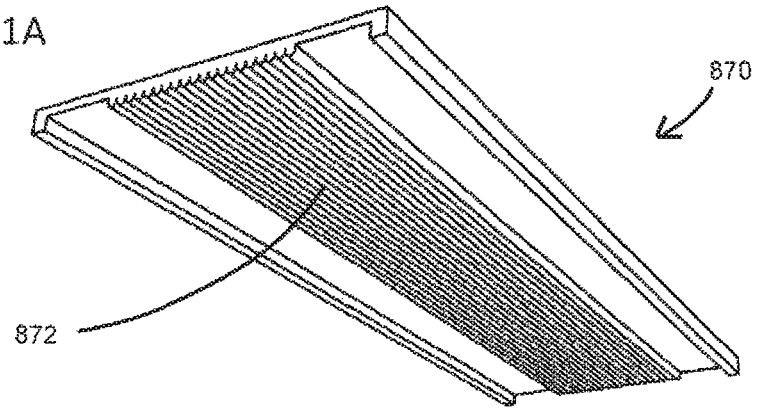
FIGS. 11A and 11B are a 3D view and a side view of a one-directional broadening element for one or more subunits.
Figure 11B:
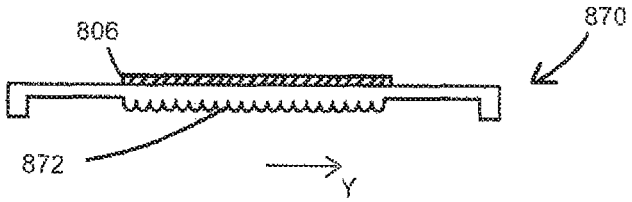
Figure 12:
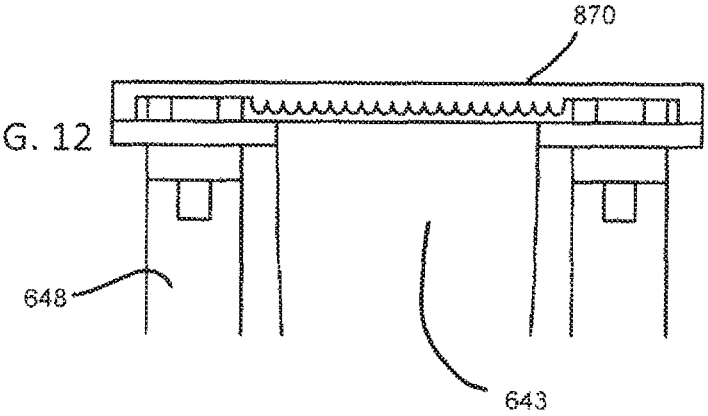
FIG. 12 is a schematic illustration of a one dimensional broadening element mounted on a subunit of CPC elements.

Referring to FIGS. 11A, 11B, and 12, the optical system of the light source for collimating the primary light of the primary light source may comprise additionally a refractive optical element 870. The refractive optical element is configured to tailor the output angular exit from the CPC array. Refractive optical element 870 is specifically configured to enlarge the angular distribution along the transverse Y-direction while introducing additionally a uniformity along this direction and/or also along X-direction if for example coupled with low angle divergence frost as described above.

Optical element 870 comprises, for example, lens elements that extent essentially linearly in the longitudinal direction X over the plurality of light emitting units, or at least a subgroup of two or more light emitting units, and is configured such that light exiting the light source 102 increases in divergence in the transverse direction (Y) to at least 50°, 60°, 90° or more degrees.

Referring to the 3D-view of FIG. 11A and the cross-section of FIG. 11B, refractive optical element 870 generates an angular fan enlargement in Y-direction by cylindrical lenses 872. Cylindrical lenses 872 form an array of linearly in X-direction extending cylindrical lens structures. The length in X-direction may be selected to cover a part of or the whole e.g. CPC array of a light source, or even more than one CPC array, i.e. multiple light sources. The refractive properties are selected to ensure that a large portion of the parabolic reflective surface of the lighting system is almost homogeneously illuminated by the light source.

As shown in FIG. 11B, the refractive optical element may be configured to comprise cylindrical lenses with an elliptical shape in the Y-Z-plane because, depending on the underlying geometry, the output angular divergence from normal cylindrical lenses may not be large enough for the size of a large curved reflective surface. In some embodiments, lenses may achieve an angular aperture in the range from 60° to 120° such as, for example, about 100°.

Furthermore, FIG. 11B illustrates a frost layer 806 positioned exemplarily on the flat side of refractive optical element 870. Frost layer 806 may enforce a small angle scattering, for example, in the range from 2° to 3°. Thereby, it provides a broadening of the local divergence in a rotational symmetric manner, which reduces shadow lines as discussed above. In some embodiments, frost layer 806 may be introduced as a separate panel e.g. mounted on top of refractive optical element 870 or the CPC arrangement.

Referring to FIG. 12, a cross-section of an exit portion of a light source with refractive optical element 870 illustrates schematically the mounting of refractive optical element 870 onto the exit side of the CPC-arrangement of exemplarily FIG. 7A. Refractive optical element 870 is mounted to distance holders 648 such that the array of cylindrical lenses extends across the individual CPC exit sides as well as the plurality of CPC elements being positioned sides by side in X-direction.

While herein, the exemplary embodiments relate in particular to noon configurations, the skilled person will appreciate that based on the underlying concepts similarly lighting systems can be made having an inclined light beam direction (e.g. by tilting the complete device or only individual elements such as the reflector).

For example, a mean reflected light beam direction (reflected light beam 220A downstream the reflection on parabolic mirror/reflective surface 204 forms an angle with the normal of exit window in the range from about 30° to about 60°, preferably from about 40° to about 50° such as 45°. In other words, the line connecting the barycenter (or areal center) of the light affected portion of the parabolic mirror/reflective surface 204 with the barycenter (or areal center) of the exit window (e.g. diffuser panel 216 with or without a Rayleigh-like diffuser material) may form an angle with the normal of exit window in those angular ranges.

For example, referring to FIG. 3A, illuminating reflective surface 204 with internal light beam 220B essentially parallel in its mean light beam direction with respect to diffuser panel 216 (with or without a Rayleigh-like diffuser material), a respective adjustment of the curvature or turning of the reflective surface 204 may result in a (reflected light beam 220A passing through diffuser panel 216 in the above ranges, e.g. under about 45°. Such embodiments may have the advantage that light source 102 is positioned on top or aside of a respective housing and is easily accessible from the top or the side.

The above angular ranges may in particular be suitable for lighting systems using appearance affecting systems such as the ones disclosed in the international patent application entitled "LIGHTING SYSTEM WITH APPEARANCE AFFECTING OPTICAL SYSTEM", filed on the same day herewith by the same applicants, which is incorporated by reference herein.

As illustrated herein, the scattering aspects are related to a relative refractive index between nanoparticles and a host material. Accordingly, nanoparticles may refer to solid particles as well as optically equivalent liquid or gaseous phase nanoscale elements such as generally liquid or gas phase inclusions (e.g. nanodroplets, nanovoids, nanoinclusion, nanobubbles etc.) having nanometric size and being embedded in the host materials. Exemplary materials that comprise gas phase inclusion (nanovoids/nanopores) in a solid matrix include aerogels that are commonly formed by a 3 dimensional metal oxides (such as silica, alumina, iron oxide) or an organic polymer (e.g. polyacrylates, polystyrenes, polyurethanes, and epoxies) solid framework hosting pores (air/gas inclusions) with dimension in the nanoscale. Exemplary materials that comprise liquid phase inclusions include liquid crystal (LC) phases with nanometric dimensions often referred to as liquid phase including nanodroplets that are confined in a matrix that commonly may have a polymeric nature. In principle, there is a large variety of LCs commercially available, e.g. by Merck KGaA (Germany). Typical classes of liquid crystal may include cyanobiphenyls and fluorinated compounds. Cyanobiphenyls can be mixed with cyanoterphenyls and with various esters. A commercial example of nematic liquid crystals belonging to this class is "E7" (Licrilite® BL001 from Merck KGaA). Furthermore, liquid crystals such as TOTN404 and ROTN-570 are available from other companies such as Hoffman-LaRoche, Switzerland.

With respect to LC, an anisotropy in refractive index may be present. This may allow to use liquid crystal droplets dispersed in a solid transparent host material as scattering particles in a nanosize range (e.g. for Rayleigh-like scattering). Specifically, one can set a contributing relative index of refraction by changing a voltage applied across the liquid crystal droplets, e.g. using a sandwich structure of an polymer dispersed liquid crystal (PDLC) layer provided in between electrical contacts (such as ITO PET films or ITO glass sheets) in a sandwich structure and applying a voltage across the PDLC layer using a power source. Specifically, creating an electric field aligns the liquid crystal orientations within distinct nanodroplets to some extent. For further details, it is referred to the international patent application entitled "TUNABILITY IN SUN-LIGHT IMITATING LIGHTING SYSTEMS", filed on the same day herewith by the same applicants, which is incorporated by reference herein.

Furthermore, as mentioned above a lighting system may have an angular beam divergence upstream the reflective surface in the longitudinal direction (X) in the range of about 0.5° to 20°, such as 3° to 15°, and the angular beam divergence in the transversal direction (Y) in the range of about 30° to 160°, such as 40° to 140°, or even 50° to 120° and/or the angular beam divergence downstream the reflective surface in the longitudinal direction (X) is in the range of about 0.5° to 20°, such as 3° to 15° and the angular beam divergence in the transversal direction (Y) is in the range of about 0.5° to 20°, such as 3° to 15° and/or wherein the angular beam divergence along the longitudinal and transvers directions downstream the reflective surface after the double-stage collimation is comparable, e.g. within a factor of three in the range of about 0.5° to 20°, such as 3° to 15°.

For example, in some embodiments, the angular aperture (angular beam divergence) of light emerging from the source and any primary optics may be in the range from 8° to 20° (one direction) and 25° to 45° (an orthogonal direction) such as 15°/35°. Moreover, the angular aperture of light reflected by the reflective surface (e.g. downstream from a parabolic reflector may be in the range from 8° to 25° (one direction) and 5° to 25° (an orthogonal direction) such as 15°/10°.

For example, upstream the reflective surface, the angular beam divergence may be 15° in the longitudinal direction (X) and in the transversal direction (Y) 35°, while downstream the reflective surface, the angular beam divergence may be maintained at about 15° in the longitudinal direction (X), while in the transversal direction (Y), the angular beam divergence may be reduced to, for example, 10°-15°.

Referring to the cylindrical lenses 872 illustrated in FIG. 11A, refractive optical element 870 may further comprise a homogenizing micro-optics array, e.g. with rectangular lenslet apertures, to generate an angular fan enlargement of light output from an array of commercially available TIR lenses associated with an array of LEDs (square LEDs).

Although the preferred embodiments of this invention have been described herein, improvements and modifications may be incorporated without departing from the scope of the following claims.

The invention claimed is:

1. A lighting system comprising:

a light source system configured to provide a light beam stripe in the visible spectral range with a low divergence in a longitudinal direction (X) and a high divergence in a transversal direction (Y) orthogonal to the longitudinal direction (X);

a reflector unit comprising a support structure and a reflective surface with an essentially linear extension in the longitudinal direction (X) and a curved extension around a focal line extending in the transverse direction (Y), wherein the light source system is positioned to emit light from the area of the focal line onto the reflective surface such that the emitted light is at least partly reflected to form a reflected light beam of directed non-diffused light with comparable divergences in the longitudinal direction (X) and the transverse direction (Y) due to a collimating effect of the reflective surface in the transverse direction (Y), and the light source system is positioned at a side of the reflected light beam; and a chromatic diffusing layer comprising a plurality of nanoparticles embedded in a matrix, wherein the chromatic diffusing layer is positioned such that at least a portion of the reflected light beam passes through the chromatic diffusing layer, thereby generating diffuse light by scattering more efficiently the short-wavelengths components of the light in the visible spectral range than the long-wavelength components of the light in the visible spectral range.

2. The lighting system of claim 1, wherein an angular beam divergence upstream the reflective surface in the longitudinal direction (X) is in the range of about 0.5° to 20°, and an angular beam divergence in the transversal direction (Y) is in the range of about 30° to 160° and an angular beam divergence downstream the reflective surface in the longitudinal direction (X) is in the range of about 0.5° to 20°, and an angular beam divergence in the transversal direction (Y) is in the range of about 0.5° to 20°.

3. The lighting system of claim 1, wherein the light source system comprises a plurality of light emitting units forming an array in the longitudinal direction (X), each light emitting unit comprising a primary light source unit configured to emit light over the visible spectral range, and a primary optical system configured to receive light from the primary light source unit and to collimate the light to a longitudinal angular spread in the longitudinal direction (X) and a transverse angular spread in the transverse direction (Y) at an output side of the primary optical system.

4. The lighting system of claim 3, wherein the light source system further comprises an optical element at an exit side of the light source system extending across the plurality of light emitting units, the optical element configured to receive the light from the plurality of light emitting units and to enlarge the beam divergence in the transversal direction to the high divergence.

5. The lighting system of claim 4, wherein the optical element comprises lens elements that extend essentially linearly in the longitudinal direction (X) over the plurality of light emitting units, or over at least a subgroup of two or more light emitting units, and the optical element is configured such that light exiting the light source system increases in divergence in the transverse direction (Y).

6. The lighting system of claim 1, wherein the light source system further comprises an optical element at an exit side of the light source system and wherein a small angle scattering layer is provided at the exit side of the light source system on one or both sides of the optical element or at a planar face of the optical element.

7. The lighting system of claim 1, further comprising an exit window through which the reflected light beam leaves the inside of the lighting system; and at least one diffusing wall element extending essentially along the propagation direction of the reflected light beam between the reflective surface and the exit window.

8. The lighting system of claim 1, wherein the reflective surface comprises its largest curvature in the transverse direction (Y) along a line extending in the longitudinal direction (X), being positioned with respect to the light source system for illumination with a central portion of the light beam stripe or being positioned at a border portion, within a border portion or out of a border portion of the light beam stripe.

9. The lighting system of claim 1, wherein the light source system comprises a plurality of light emitting units and wherein at least one of the light emitting units comprises a plurality of LED arrangements with emitting areas that are arranged side by side to form an LED strip and form a rectangular zone emitting light and the light of the plurality of LED arrangements is collected and collimated by a respective optical system.

10. The lighting system of claim 1, wherein the reflector unit comprises a linear parabolic reflective surface that extends over an angular range in the transverse direction (Y) such that the light source system is positioned substantially outside of the reflected light beam.

11. The lighting system of claim 1, wherein the chromatic diffusing layer is positioned next to and upstream of the reflective surface such that at least a portion of the light beam passes through the chromatic diffusing layer before and after being reflected by the curved reflective surface, and the reflective surface and the chromatic diffusing layer are configured to provide for a specular reflectance that is larger in a red portion of the spectrum than in a blue portion of the spectrum and for a diffuse reflectance that is larger in the blue portion of the spectrum than in the red portion of the spectrum, or wherein the nanoparticles and the matrix are essentially non-absorbing.

12. The lighting system of claim 1, wherein a difference in the refractive index of the nanoparticles with respect to the refractive index of the matrix, a size distribution of the nanoparticles, and a number of nanoparticles per unit surface area are selected to provide for the specular reflectance to be larger in a red portion of the spectrum than in a blue portion of the spectrum and for the diffuse reflectance to be larger in the blue portion of the spectrum than in the red portion of the spectrum.

13. The lighting system of claim 1, wherein the light source system further comprises an optical element at an exit side of the light source system, and wherein at least one of a separate layer or panel, the chromatic diffusing layer, and the optical element further comprises low angle diffusing particles or a surface structure that respectively contribute to an increased forward scattering, wherein the low angle diffusing particles and the surface structure have a size larger than the nanoparticles acting as chromatic scatterers.

14. An illumination system comprising:

a plurality of lighting systems as recited in claim 1, wherein neighboring lighting systems are positioned next to each other in the longitudinal direction (X) such that the reflective surfaces form a continuous surface resulting in a stripe-shaped light beam comprising a sequence of light beams of the plurality of lighting systems.

15. The lighting system of claim 1, wherein the chromatic diffusing layer is panel shaped or configured as a coating on a mirror foil formed in a trough-like shape, or wherein the chromatic diffusing layer comprises light-scattering elements of average size in the range of about and smaller than 250 nm, or in the range between 10 nm and 250 nm that contribute to chromatic scattering.

16. The lighting system of claim 1, wherein the light source system further comprises an optical element at an exit side of the light source system and wherein at least one of a separate layer or panel, the chromatic diffusing layer, and the optical element further comprises low angle diffusing particles or a surface structure that respectively contribute to an increased forward scattering;

wherein the low angle diffusing particles scatter with a full width half maximum divergence that is narrower than the full width half maximum divergence generated by the chromatic diffusing layer or that is three times smaller than the full width half maximum divergence generated by the chromatic diffusing layer.

17. A lighting system comprising:

a light source system configured to provide a light beam stripe in the visible spectral range with a low divergence in a longitudinal direction (X) and a high divergence in a transversal direction (Y) orthogonal to the longitudinal direction (X);

a reflector unit comprising a support structure and a reflective surface with an essentially linear extension in the longitudinal direction (X) and a curved extension around a focal line extending in the transverse direction (Y), wherein the light source system is positioned to emit light from the area of the focal line onto the reflective surface such that the emitted light is at least partly reflected to form a reflected light beam of directed non-diffused light with comparable divergences in the longitudinal direction (X) and the transverse direction (Y) due to a collimating effect of the reflective surface in the transverse direction (Y); and a chromatic diffusing layer comprising a plurality of nanoparticles embedded in a matrix, wherein the chromatic diffusing layer is positioned such that at least a portion of the reflected light beam passes through the chromatic diffusing layer, thereby generating diffuse light by scattering more efficiently the short-wavelengths components of the light in the visible spectral range than the long-wavelength components of the light in the visible spectral range, wherein a small angle scattering layer is provided at an exit side of the light source.

18. The lighting system of claim 17, wherein an angular beam divergence upstream the reflective surface in the longitudinal direction (X) is in the range of about 0.5° to 20°, and an angular beam divergence in the transversal direction (Y) is in the range of about 30° to 160° and an angular beam divergence downstream the reflective surface in the longitudinal direction (X) is in the range of about 0.5° to 20°, and an angular beam divergence in the transversal direction (Y) is in the range of about 0.5° to 20°.

19. The lighting system of claim 17, wherein the light source system comprises a plurality of light emitting units forming an array in the longitudinal direction (X), each light emitting unit comprising a primary light source unit configured to emit light over the visible spectral range, and a primary optical system configured to receive light from the primary light source unit and to collimate the light to a longitudinal angular spread in the longitudinal direction (X) and a transverse angular spread in the transverse direction (Y) at an output side of the primary optical system.

20. The lighting system of claim 19, wherein the light source system further comprises an optical element at the exit side of the light source system extending across the plurality of light emitting units, the optical element configured to receive the light from the plurality of light emitting units and to enlarge the beam divergence in the transversal direction to the high divergence.

21. The lighting system of claim 17, wherein the reflective surface comprises its largest curvature in the transverse direction (Y) along a line extending in the longitudinal direction (X).

22. The lighting system of claim 17, wherein the chromatic diffusing layer is positioned next to and upstream of the reflective surface such that at least a portion of the light beam passes through the chromatic diffusing layer before and after being reflected by the curved reflective surface and the reflective surface and the chromatic diffusing layer are configured to provide for a specular reflectance that is larger in a red portion of the spectrum than in a blue portion of the spectrum and for a diffuse reflectance that is larger in the blue portion of the spectrum than in the red portion of the spectrum, or wherein the nanoparticles and the matrix are essentially non-absorbing.

23. The lighting system of claim 17, wherein a difference in the refractive index of the nanoparticles with respect to the refractive index of the matrix, a size distribution of the nanoparticles, and a number of nanoparticles per unit surface area are selected to provide for the specular reflectance to be larger in a red portion of the spectrum than in a blue portion of the spectrum and for the diffuse reflectance to be larger in the blue portion of the spectrum than in the red portion of the spectrum.

24. The lighting system of claim 17, wherein the chromatic diffusing layer is panel shaped or configured as a coating on a mirror foil formed in a trough-like shape, or wherein the chromatic diffusing layer comprises light-scattering elements of average size in the range of about and smaller than 250 nm, or in the range between 10 nm and 250 nm that contribute to chromatic scattering.

* * * * *